US008079444B1

(12) United States Patent
Rands et al.

(10) Patent No.: US 8,079,444 B1
(45) Date of Patent: Dec. 20, 2011

(54) TRANSPORTABLE, SELF-ERECTING, BATTERY POWERED, VERTICAL LIFT ASSEMBLY

(75) Inventors: William J. Rands, Ladysmith, WI (US); Michael S. Schumacher, Chetek, WI (US)

(73) Assignee: Elevated Technologies, LLC, Rice Lake, WI (US)

( * ) Notice: Subject to any disclaimer, the term of this patent is extended or adjusted under 35 U.S.C. 154(b) by 582 days.

(21) Appl. No.: 12/315,946

(22) Filed: Dec. 8, 2008

Related U.S. Application Data

(60) Provisional application No. 61/063,407, filed on Feb. 1, 2008, provisional application No. 61/128,231, filed on May 20, 2008.

(51) Int. Cl.
*E06C 5/00* (2006.01)

(52) U.S. Cl. ..... 182/141; 182/20; 182/69.3; 182/69.6; 182/133; 182/187; 187/240; 187/242

(58) Field of Classification Search ..... 182/20, 182/69.3, 69.6, 133, 141, 142, 148, 187; 197/239, 240, 243, 244
See application file for complete search history.

(56) References Cited

U.S. PATENT DOCUMENTS

| | | | | | |
|---|---|---|---|---|---|
| 1,943 | A | * | 1/1841 | Welch | 187/243 |
| 2,531,346 | A | | 11/1950 | Schuchert | |
| 2,757,756 | A | * | 8/1956 | Warry | 187/243 |
| 3,276,546 | A | | 10/1966 | Slais | |
| 3,517,774 | A | | 6/1970 | Meyer | |
| 4,194,591 | A | * | 3/1980 | Fisher | 182/17 |
| 4,353,308 | A | | 10/1982 | Brown | |
| 4,397,373 | A | * | 8/1983 | Ream et al. | 182/17 |
| 4,592,447 | A | * | 6/1986 | Ream et al. | 182/127 |
| 4,633,538 | A | | 1/1987 | James | |
| 4,862,997 | A | | 9/1989 | Eberle | |
| 4,987,976 | A | | 1/1991 | Daugherty | |
| 5,070,792 | A | | 12/1991 | Harris | |
| 5,102,179 | A | | 4/1992 | Royer | |
| 5,143,181 | A | * | 9/1992 | Bixby | 187/242 |
| 5,322,408 | A | | 6/1994 | Wooden | |
| 5,595,265 | A | | 1/1997 | Lebrocquy | |
| 5,960,909 | A | | 10/1999 | Horcher et al. | |
| 5,979,602 | A | | 11/1999 | Grout | |
| 6,290,023 | B1 | * | 9/2001 | Martin | 182/127 |
| 6,347,684 | B1 | * | 2/2002 | Fath et al. | 182/63.1 |
| 6,523,641 | B2 | * | 2/2003 | Smith | 182/63.1 |
| 6,640,934 | B1 | | 11/2003 | Edwards | |
| 6,978,862 | B1 | * | 12/2005 | Cotten, Sr. | 182/127 |
| 7,281,607 | B1 | * | 10/2007 | Kiraly | 182/82 |
| 2002/0017429 | A1 | * | 2/2002 | McCowan | 182/63.1 |
| 2007/0089930 | A1 | * | 4/2007 | Friesenhahn | 182/127 |
| 2007/0125599 | A1 | * | 6/2007 | Campbell et al. | 182/148 |
| 2008/0302601 | A1 | * | 12/2008 | Baker | 182/69.4 |

* cited by examiner

*Primary Examiner* — Alvin Chin Shue
*Assistant Examiner* — Colleen M Quinn
(74) *Attorney, Agent, or Firm* — Tipton L. Randall

(57) ABSTRACT

A transportable, self-erecting, battery powered, vertical lift assembly includes a wheeled frame with a towing attachment mechanism. A linear guide member with an exterior roller chain member is pivotally secured to the frame. A carriage member with attached platform member is movably mounted to the linear guide member adjacent the frame. The carriage member includes an attached drive mechanism with a battery powered DC motor driving a gear unit operatively connected to a sprocket, which engages the roller chain member on the linear guide member. The carriage member and attached platform member are movable along the linear guide member by the drive mechanism to pivot and elevate the guide member, which engages a vertical support structure, and to elevate the carriage member and attached platform member. A safety brake assembly immobilizes the carriage member with respect to the linear guide member upon relative movement between the carriage member and drive mechanism.

18 Claims, 26 Drawing Sheets

TRANSPORTABLE, SELF-ERECTING, BATTERY POWERED, VERTICAL LIFT ASSEMBLY

CROSS-REFERENCE TO RELATED APPLICATIONS, IF ANY

This application claims the benefit under 35 U.S.C. §119 (e) of provisional application Ser. No. 61/063,407, filed 1 Feb. 2008, and Ser. No. 61/128,231, filed 20 May 2008. Application Ser. No. 61/063,407 and Ser. No. 61/128,231 are hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a transportable lift assembly and, more particularly, to a transportable, battery powered lift assembly with a support platform and, most particularly, to a transportable, self-erecting, battery powered lift assembly with a support platform that is suitable for use by an individual with limited mobility.

2. Background Information

The present invention pertains to a transportable vertical lift assembly, as may be used to lift wheelchair-bound hunters to an elevated location. As our society progresses, the number of activities which are accessible to the physically disadvantaged, or in which the physically disadvantaged desire to participate, is also increasing. Sports for the wheelchair-bound, such as racing and basketball, are no exceptions to this trend, and hunting is included among these sports. However, in many cases, the physically disadvantaged present unique needs, and special devices are required to allow for their full participation. For example, a physically disadvantaged hunter confined to a wheelchair presents a real challenge. It is common for hunters to construct a tree stand in a tree and then wait in the tree stand for game to come by. Such a feat is extremely impractical for a hunter confined to a wheelchair. A need exists for a technology to overcome this barrier to the disabled hunter.

Applicants have devised a transportable, self-erecting, battery powered vertical lift assembly suitable for use by any individual, including an individual confined to a wheelchair.

SUMMARY OF THE INVENTION

The invention is directed to a transportable, self-erecting, battery powered, vertical lift assembly adapted for raising and lowering a load vertically along a substantially linear structure. The transportable, self-erecting, battery powered, vertical lift assembly includes a wheeled frame member having an axle and two wheel members, secured to one end of the frame member and a towing attachment mechanism at an opposite end of the frame member. A linear guide member is pivotally secured at a first end to the frame member adjacent to the axle and two wheel members thereof. A link chain member is secured to an exterior surface of the linear guide member and extends essentially the length of the linear guide member. A carriage member is movably attached to the linear guide member, and a platform member is attached to the carriage member. The carriage member and platform member are positioned between the frame member and a second end of the linear guide member.

The carriage member includes a drive mechanism, comprising a battery powered DC motor, driving a worm gear operatively connected to a sprocket. The drive mechanism is attached to the carriage member, with the sprocket engaging the link chain member secured to the linear guide member. The carriage member and attached platform member are movable toward the first end of the linear guide member by controlled rotation of the sprocket, engaged with the link chain member on the linear guide member, to pivot and elevate the guide member, which engages an essentially vertical support structure. The carriage member and attached platform member then are moveable toward the second end of the linear guide member by controlled rotation of the sprocket, engaged with the link chain member on the linear guide member, to elevate the carriage member and attached platform member. A safety brake assembly is actuated to immobilizing the carriage member with respect to the linear guide member upon power loss between the battery and the DC motor. The safety brake assembly locks the carriage member to the linear guide member until power is restored to the drive mechanism.

DESCRIPTION OF THE EMBODIMENTS

Nomenclature

Figure 1:
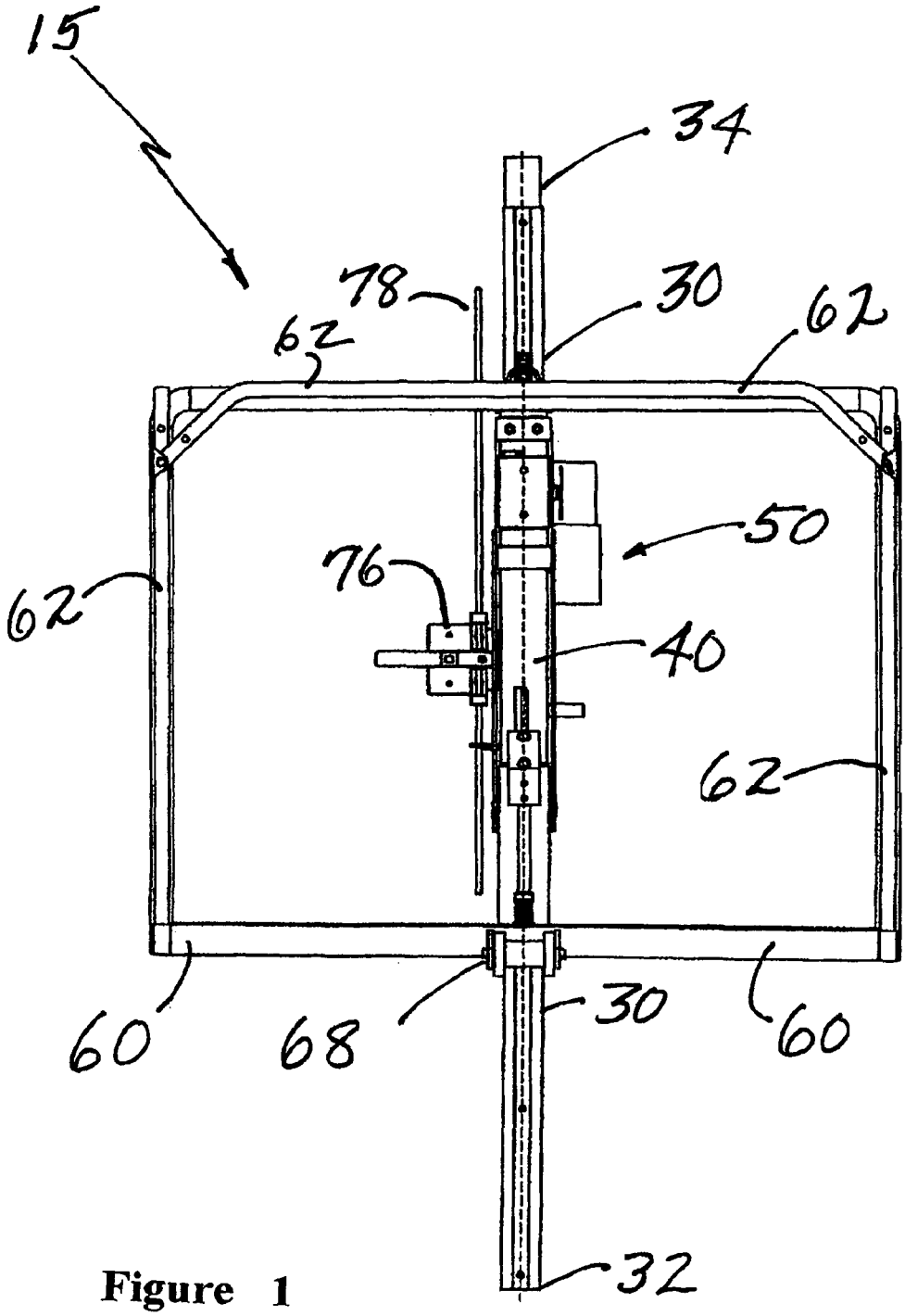
FIG. 1 is a front view of the platform member and carriage member engaged with the linear guide member of the present invention.
Figure 2:
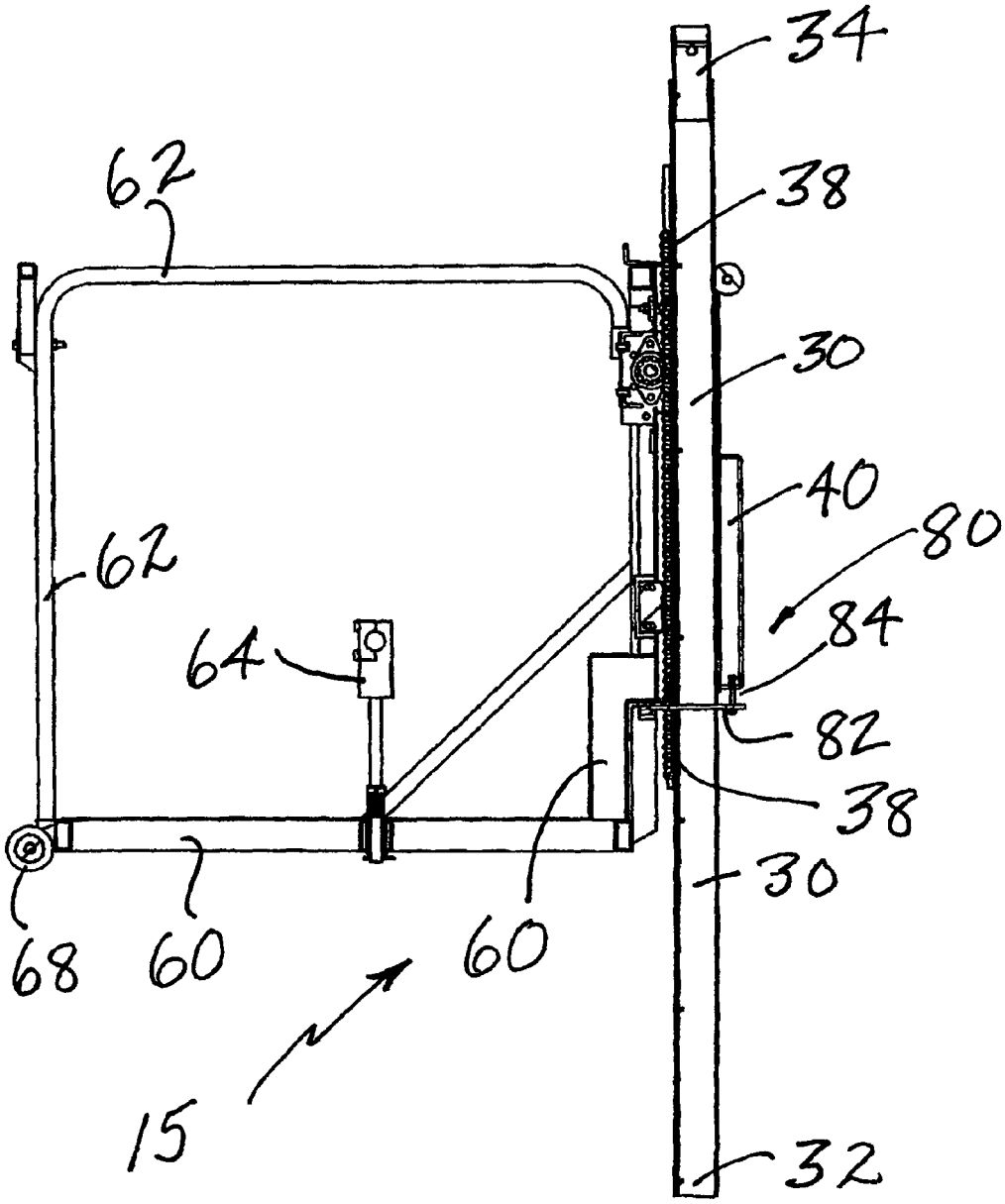
FIG. 2 is a side view of the platform member and carriage member engaged with the linear guide member of the present invention.
Figure 3:
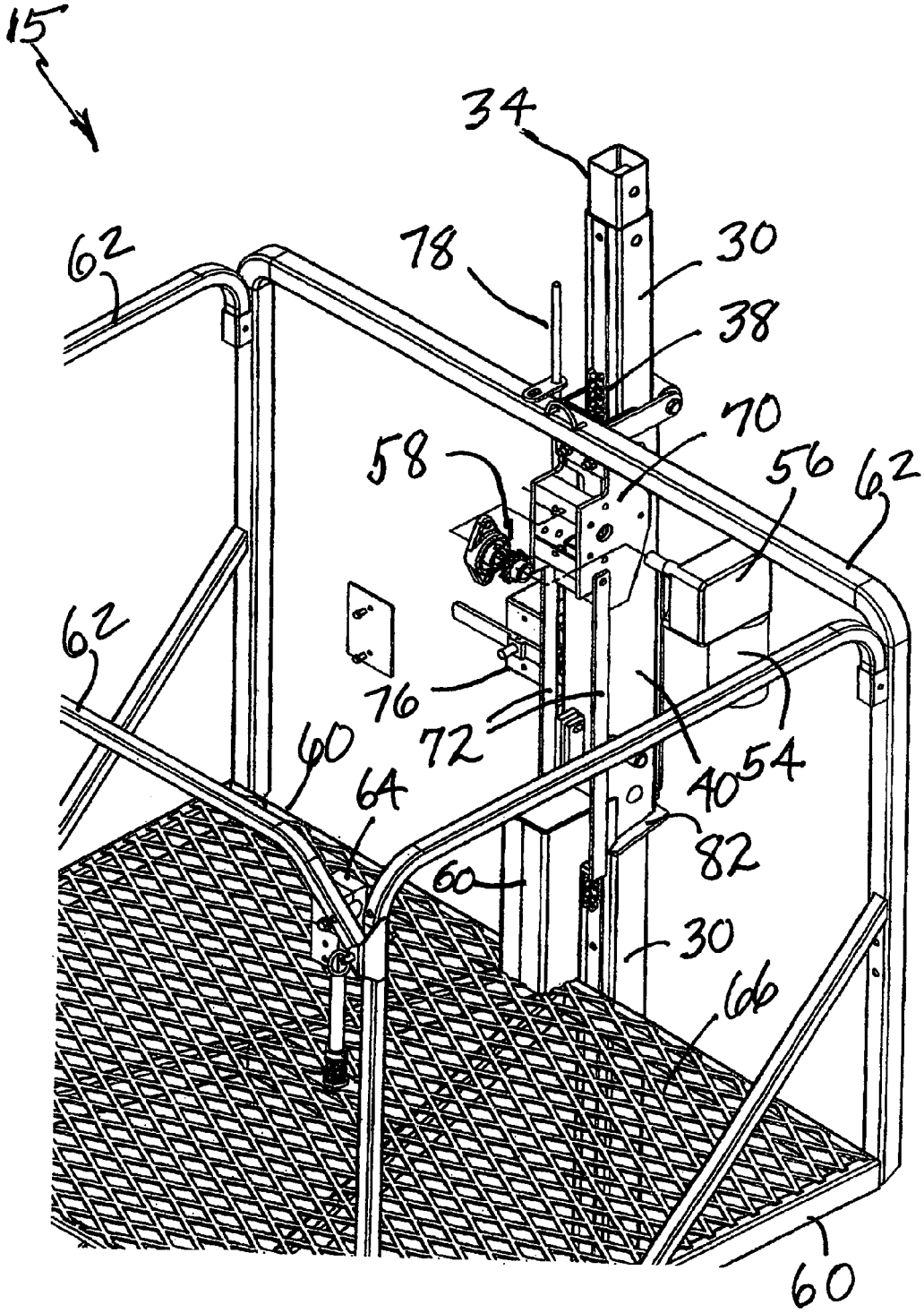
FIG. 3 is a perspective view of the platform member and carriage member with an exploded view of the elements of the drive mechanism of the present invention.
Figure 4:
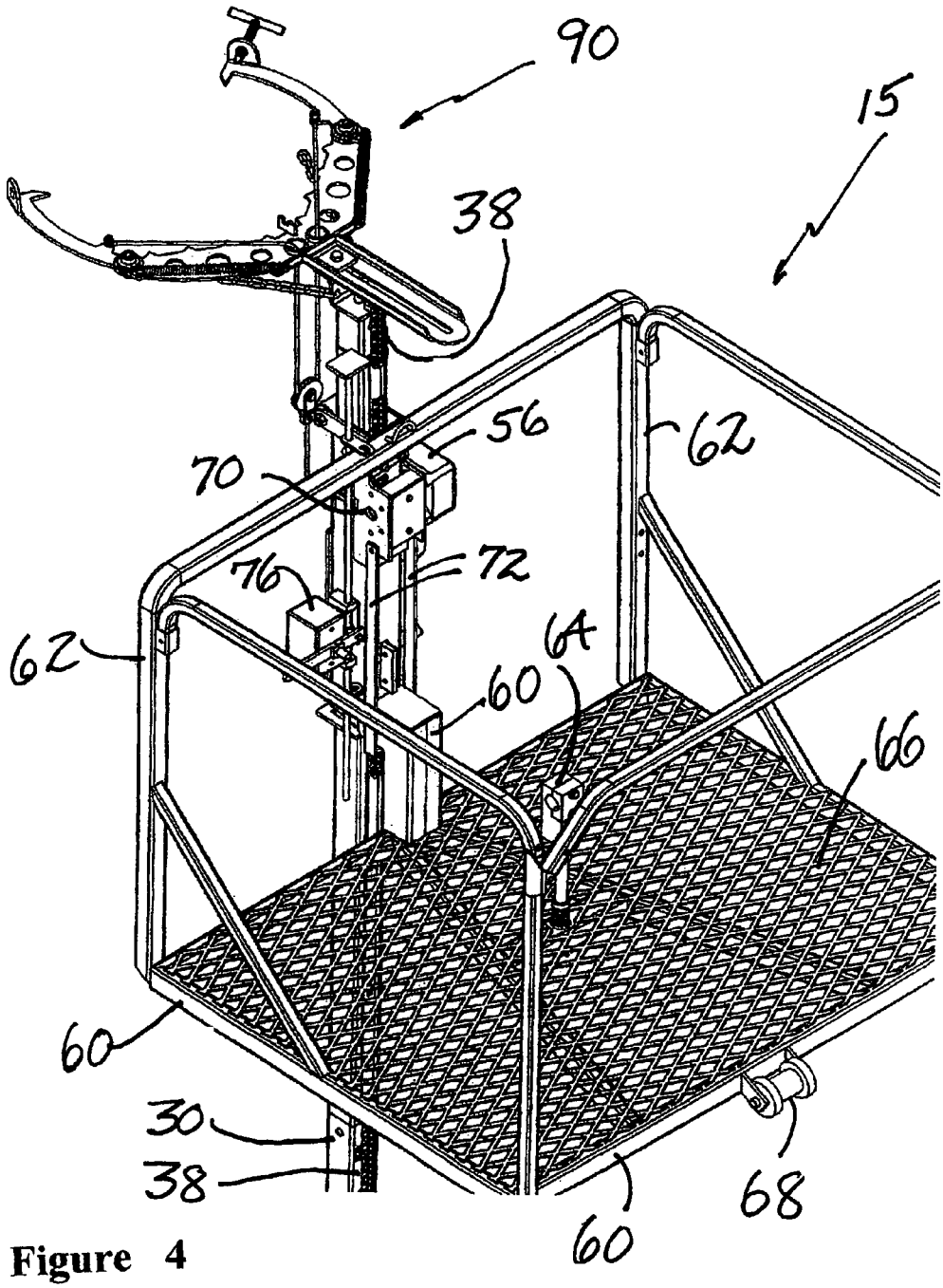
FIG. 4 is another perspective view of the platform member and carriage member with the drive mechanism engaged with the roller chain member, the linear guide member with an anchoring assembly of the present invention.

10 Transportable, Self-Erecting, Battery Powered, Vertical Lift Assembly
15 Lifting Portion of Vertical Lift Assembly -continued 20 Wheeled Frame Member
22 Axle
24 Wheel Members
26 Towing Attachment Mechanism
28 Stabilizer Frame Section
30 Linear Guide Member
32 First End of Guide Member
34 Second End of Guide Member
38 Roller Chain Member
40 Carriage Member
42 Upper End of Carriage Member
44 Lower End of Carriage Member
46 Mounting Opening of Carriage Member
48 Contact Surface of Carriage Member
50 Drive Mechanism
52 Battery Member
54 DC Motor Member
56 Gear Unit
58 Sprocket Member
60 Platform Member
62 Safety Railing
64 Locking Peg
66 Expanded Mesh Floor
68 Roller Member
70 Mounting Frame of Drive Mechanism
72 Actuation Arms to Brake Clamp Member
74 Connecting Plate between Actuation Arms
76 Control Switch Member
78 Handle Portion of Control Switch Member
80 Safety Brake Assembly
82 Brake Clamp Member
84 Biasing Spring of Safety Brake
90 First Anchoring Assembly
95 Second Anchoring Assembly
100 Shelter Member
110 Power Shaft Member
120 Shelter Access Opening
130 Shelter Viewing Window

Construction

The invention is directed to a transportable, self-erecting, battery powered, vertical lift assembly adapted for raising and lowering a load vertically along a substantially linear structure. The transportable, self-erecting, battery powered, vertical lift assembly includes a wheeled frame member, having an axle and two wheel members secured to one end of the frame member, and a towing attachment mechanism at an opposite end of the frame member. A linear guide member is pivotally secured at a first end to the frame member, adjacent to the axle and two wheels thereof. A link chain member is secured to an exterior surface of the linear guide member and extends essentially the length of the linear guide member. A carriage member is movably attached to the linear guide member, and a platform member is attached to the carriage member. The carriage member and platform member are positioned between the frame member and a second end of the linear guide member.

The carriage member includes a drive mechanism comprising a battery powered DC motor driving a gear unit operatively connected to a sprocket. The drive mechanism is attached to the carriage member, with the sprocket engaging the link chain member secured to the linear guide member. The carriage member and attached platform member are movable toward the first end of the linear guide member by controlled rotation of the sprocket, engaged with the link chain member on the linear guide member, to pivot and elevate the guide member, which engages an essentially vertical support structure. The carriage member and attached platform member then are moveable toward the second end of the linear guide member by controlled rotation of the sprocket, engaged with the link chain member on the linear guide member, to elevate the carriage member and attached platform member. A safety brake assembly is actuated to immobilize the carriage member with respect to the linear guide member, upon power loss between the battery and the DC motor. The safety brake assembly locks the carriage member to the linear guide member until power is restored to the drive mechanism.

Referring now to FIGS. 1-8, several views of the lifting portion 15 of the transportable, self-erecting, battery powered, vertical lift assembly 10 of the present invention are shown. The transportable, self-erecting, battery powered, vertical lift assembly 10 is adapted for raising and lowering a load vertically and is completely portable. The structure and function of the power train and platform of the vertical lift assembly 10 are detailed in a copending utility patent application Ser. No. 12/231,864, filed Sep. 8, 2008. Application Ser. No. 12/231,864 is hereby incorporated by reference.

The transportable, self-erecting, battery powered vertical lift assembly 10 comprises a hollow, linear guide member 30 of selected length, most preferably with a rectangular cross section. The linear guide member 30 has a first end 32 and a second end 34 and is adapted for securing to a substantially vertical structure, such as a building, a pole, or a tree. The linear guide member 30 may be a single, unitary structure or assembled from two or more subunits to provide an extended length. A roller chain member 38 is secured to an exterior surface of the linear guide member 30 and extends essentially the full length of the linear guide member 30. Preferably, the roller chain member 38 is securely anchored at one end, adjacent the first end 32 of the guide member 30, and at the opposite end, adjacent the second end 34 of the guide member 30.

Figure 5:
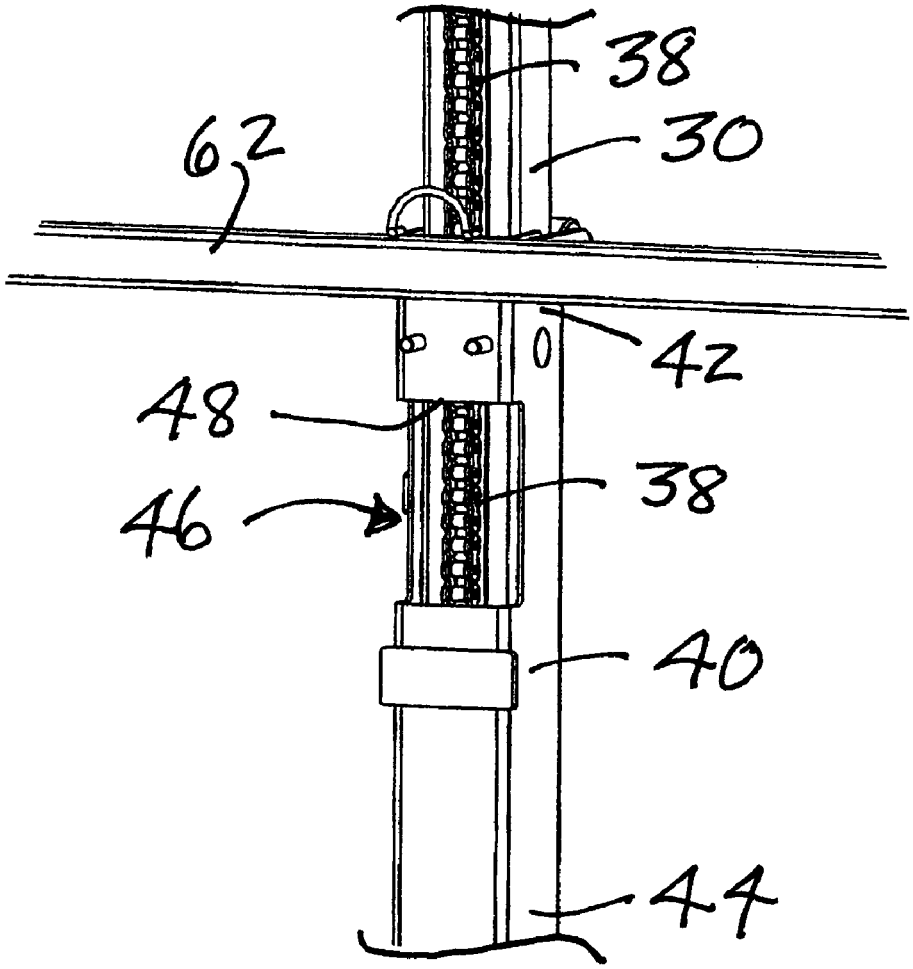
FIG. 5 is a perspective front view of the carriage member with the mounting opening exposing the roller chain member of the present invention.

A carriage member 40 is movably attached to the linear guide member 30, with the carriage member 40 essentially encircling the linear guide member 30 and the roller chain member 38 attached thereto. Preferably, the carriage member 40 is also rectangular in cross section to conform to the rectangular linear guide member 30. The carriage member 40 has an upper end 42 and a lower end 44 and includes a mounting opening 46 centered over the roller chain member 38, which allows the drive mechanism 50 to engage the roller chain member 38. The mounting opening 46 is best seen in FIG. 5.

A platform member 60, which supports a load, is rigidly attached to the carriage member 40 in an essentially perpendicular orientation thereto. Preferably, the platform member 60 is fabricated from rectangular tubing with an expanded metal base for supporting the load thereon. The platform member 60 includes a safety railing 62, surrounding at least a portion of the platform member 60, and a vertical locking peg 64, extending upwardly from the platform member 60. The locking peg 64 functions to secure a wheel chair to the platform member 60, so the vertical lift assembly 10 can be safely used by an individual in the wheel chair.

The carriage member 40 is raised and lowered along the linear guide member 30 by a drive mechanism 50, supporting the carriage member 40. As indicated above, the drive mechanism 50 is positioned over the mounting opening 46 and engages the roller chain member 38. The drive mechanism 50 includes a mounting frame 70 that engages the contact surface 48 (FIG. 5) of the mounting opening 46 of the carriage member 40.

Figure 6:
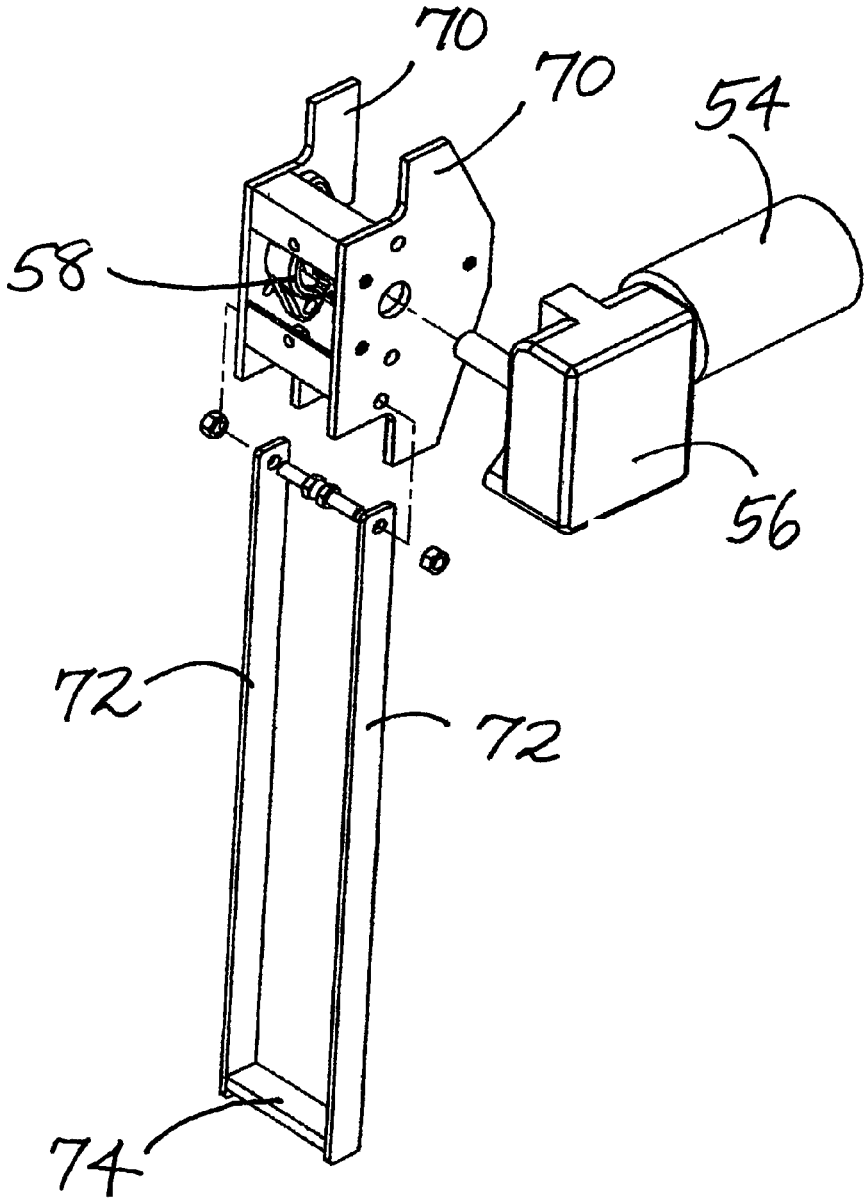
FIG. 6 is an exploded, perspective view of the drive mechanism with actuation arms of the present invention.

The drive mechanism 50 comprises a battery member 52 powering a DC motor member 54, which drives a gear unit 56, such as a worm gear member, that is operatively connected to a sprocket member 58. The DC motor member 54, gear unit 56, and sprocket member 58 are secured within the mounting frame 70, as shown in FIG. 6. The sprocket member 58 engages the roller chain member 38 on the linear guide member 30. The carriage member 40 and attached platform member 60 are raised and lowered by controlled rotation of the sprocket member 58 engaged with the roller chain member 38 on the linear guide member 30.

A control switch member 76 selectively controls operation of the DC motor member 54. The control switch member 76 includes a handle portion 78 that actuates the DC motor member 54 to raise the carriage member 40 and attached platform member 60 upon raising the handle portion 76. The control switch member 76 also actuates the DC motor member 54 to lower the carriage member 40 and attached platform member 60 upon lowering the handle portion 78.

Figure 7:
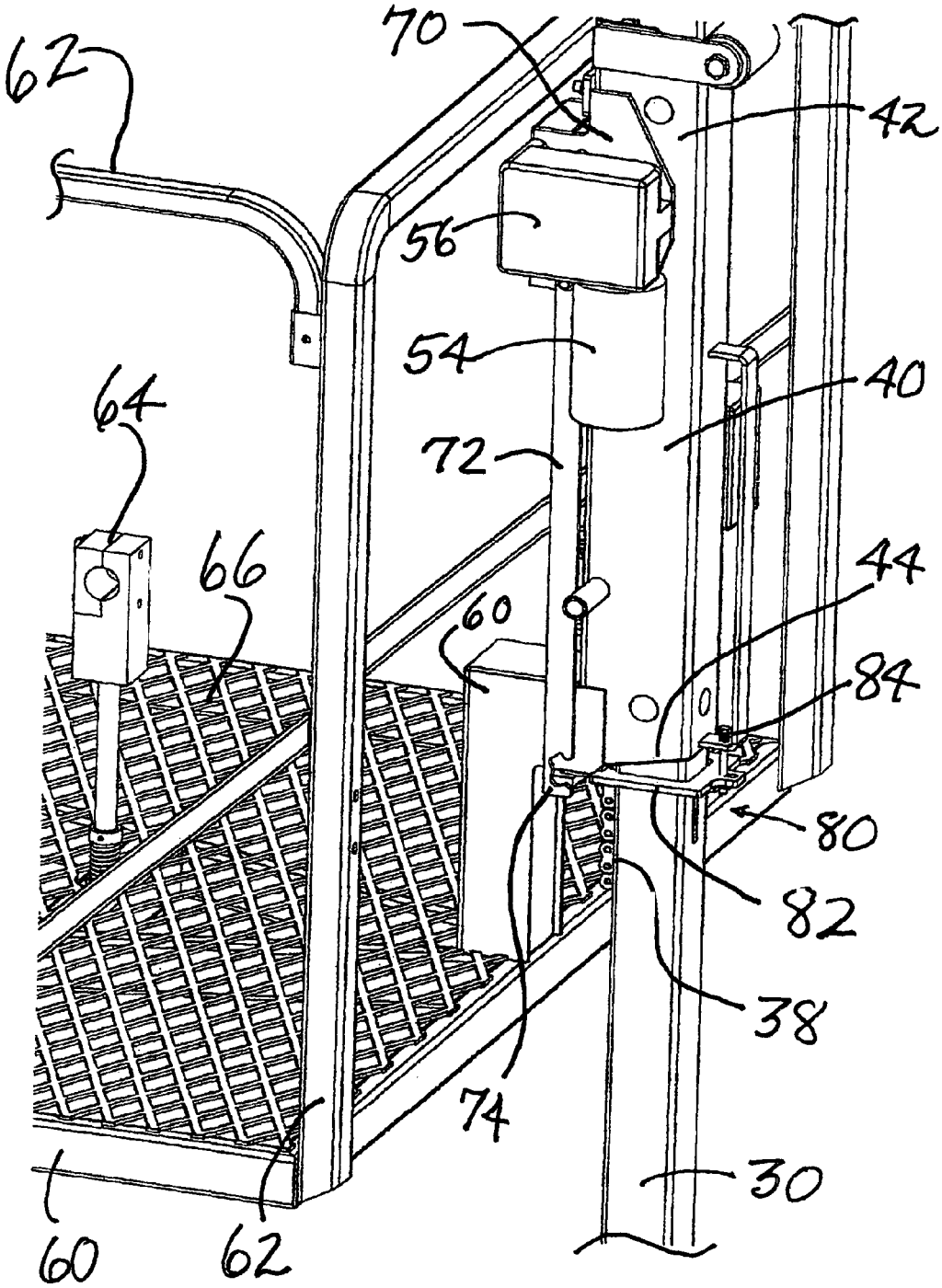
FIG. 7 is a perspective, side view of the platform member and attached carriage member with the safety brake assembly in an unlocked state of the present invention.
Figure 8:
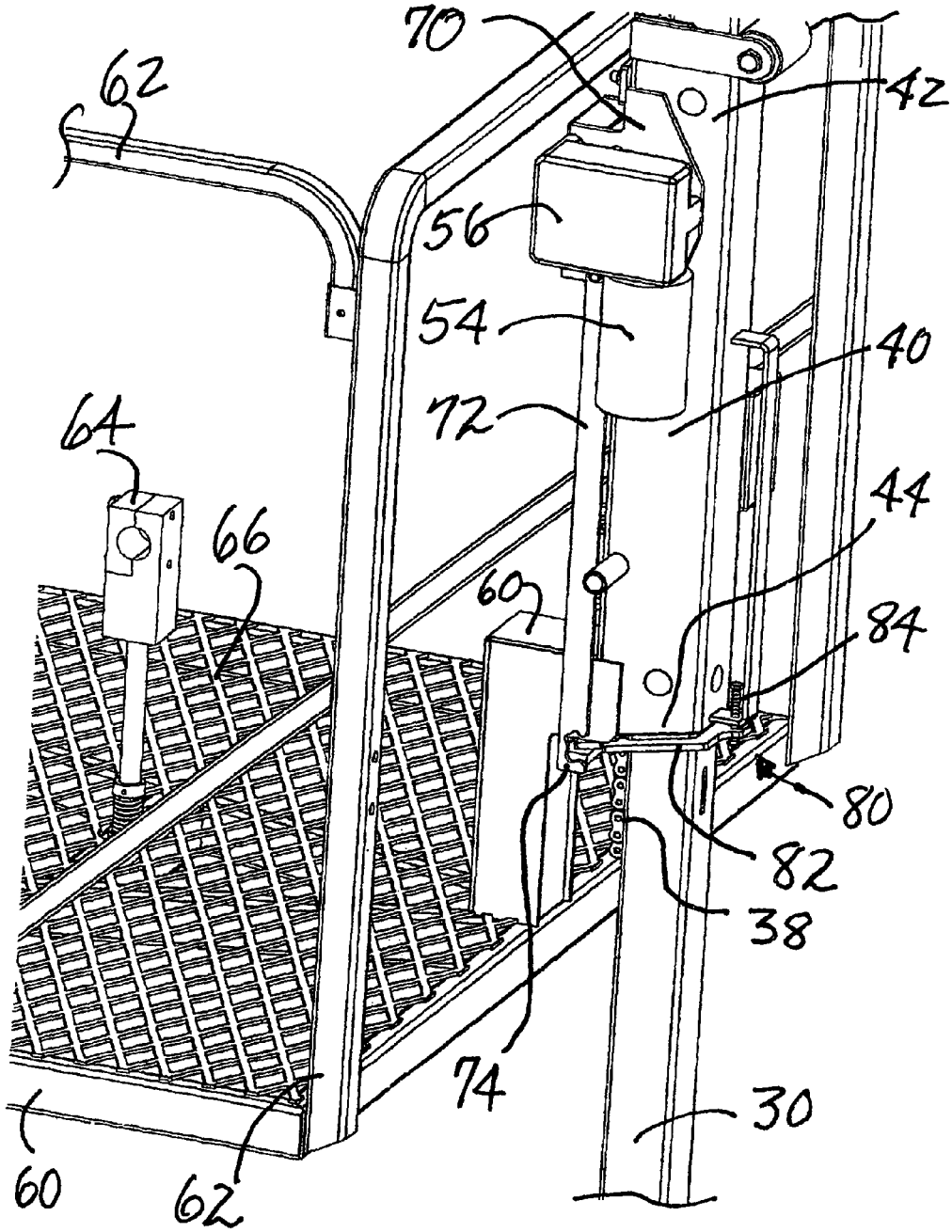
FIG. 8 is a perspective, side view of the platform member and attached carriage member with the safety brake assembly in a locked state of the present invention.
Figures 9A, 9B:
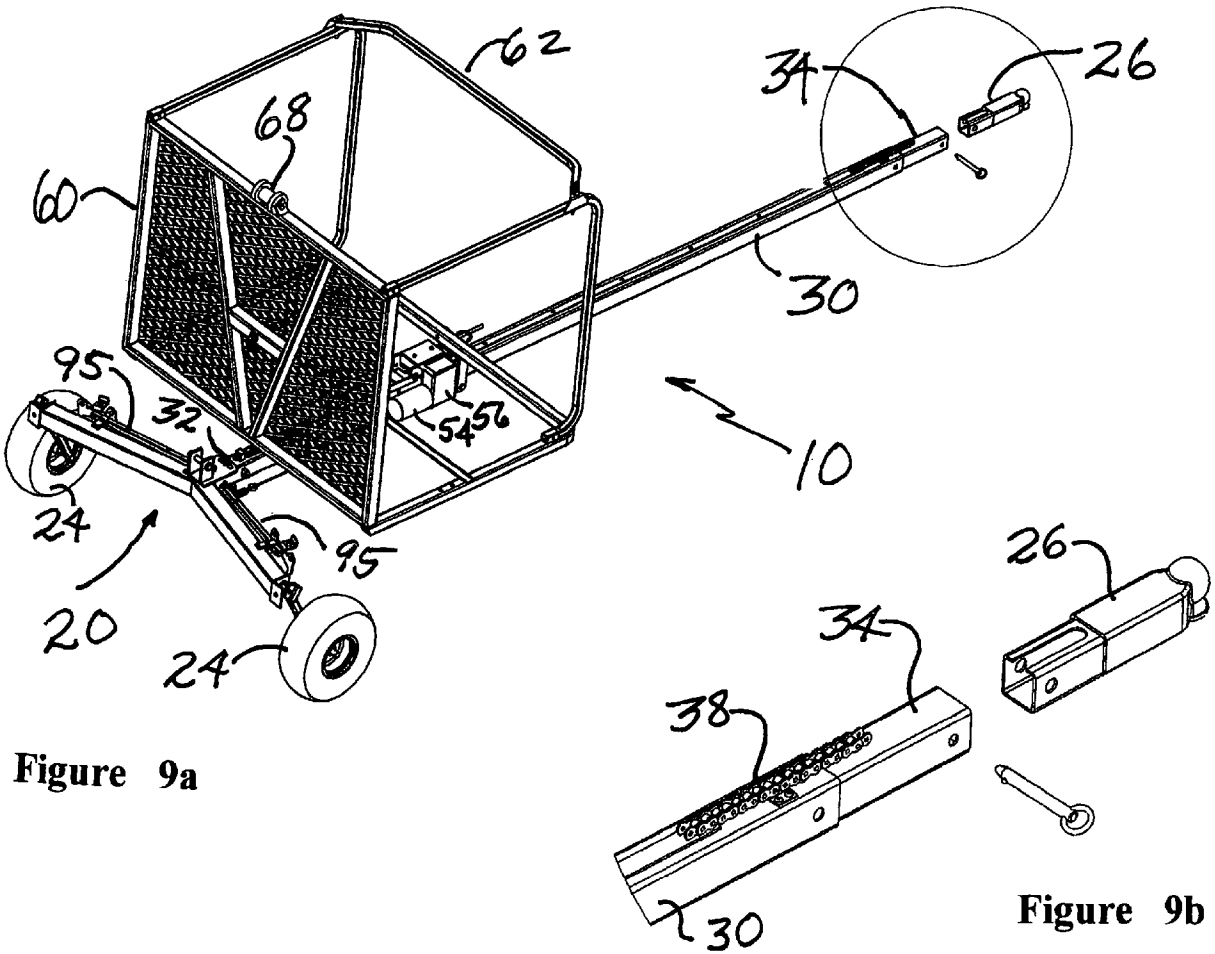
FIG. 9*a* is a perspective view of a first embodiment of the transportable, self-erecting, battery powered, vertical lift assembly of the present invention.
FIG. 9*b* is a close up perspective view of the towing attachment mechanism and linear guide member of FIG. 9*a*.

A safety brake assembly 80 is actuated to immobilize the carriage member 40, with respect to the linear guide member 30, upon relative movement between the carriage member 40 and the drive mechanism 50. The mounting frame 70 of the drive mechanism 50 supports the carriage member 40, as described above. The safety brake assembly 80 includes a biased brake clamp member 82, encircling the linear guide member 30 and pivotally contacting the carriage member 40 below the lower end 44 of the carriage member 40. As shown in FIGS. 7 and 8, the lower end 44 of the carriage member 40 is beveled, with the low point of the lower end 44 of the carriage member 40 adjacent the platform member 60. A pair of brake actuation arms 72 extends vertically downward from the mounting frame 70 of the drive mechanism 50, with a connecting plate 74 joining the ends of the arms 72 opposite the mounting frame 70 (FIG. 6). The brake clamp member 82 is biased upwardly by a biasing spring 84, attached to the carriage member 40 opposite the low point of the lower end 44 thereof. The connecting plate 74, attached to the brake actuation arms 72, applies force to the under side of the brake clamp member 82 to hold the brake clamp member 82 essentially perpendicular to the linear guide member 30 to allow movement of the brake clamp member 82 on the linear guide member 30. In this unlocked state, the carriage member 40 and attached platform member 60 are free to move upwardly or downwardly on the linear guide member 30, by means of the drive mechanism 50. Should there be a mechanical or electrical failure of the system, such as failure of the roller chain member 38, the drive mechanism 50 will move out of contact with the contact surface 48 of the carriage member 40. Such movement removes the force from the under side of the brake clamp member 82, and the biasing spring 84 pulls the brake clamp member 82 away from the perpendicular, unlocked state to a non-perpendicular, locked state to prevent downward movement of the carriage member 40 and attached platform member 60. The unlocked condition and the locked condition for the brake clamp member 82 are illustrated in FIGS. 7 and 8, respectively. Thus, the brake clamp member 82 is biased in an unlocked state, with the drive mechanism 50 supporting the carriage member 40. The brake clamp member 82 is actuated to a locked state upon relative movement between the carriage member 40 and the drive mechanism 50, thereby locking the carriage member 40 and attached platform member 60 to the linear guide member 30. This extremely important safety feature makes the transportable, self-erecting, battery powered, vertical lift assembly 10 of the present invention unique.

Figure 10:
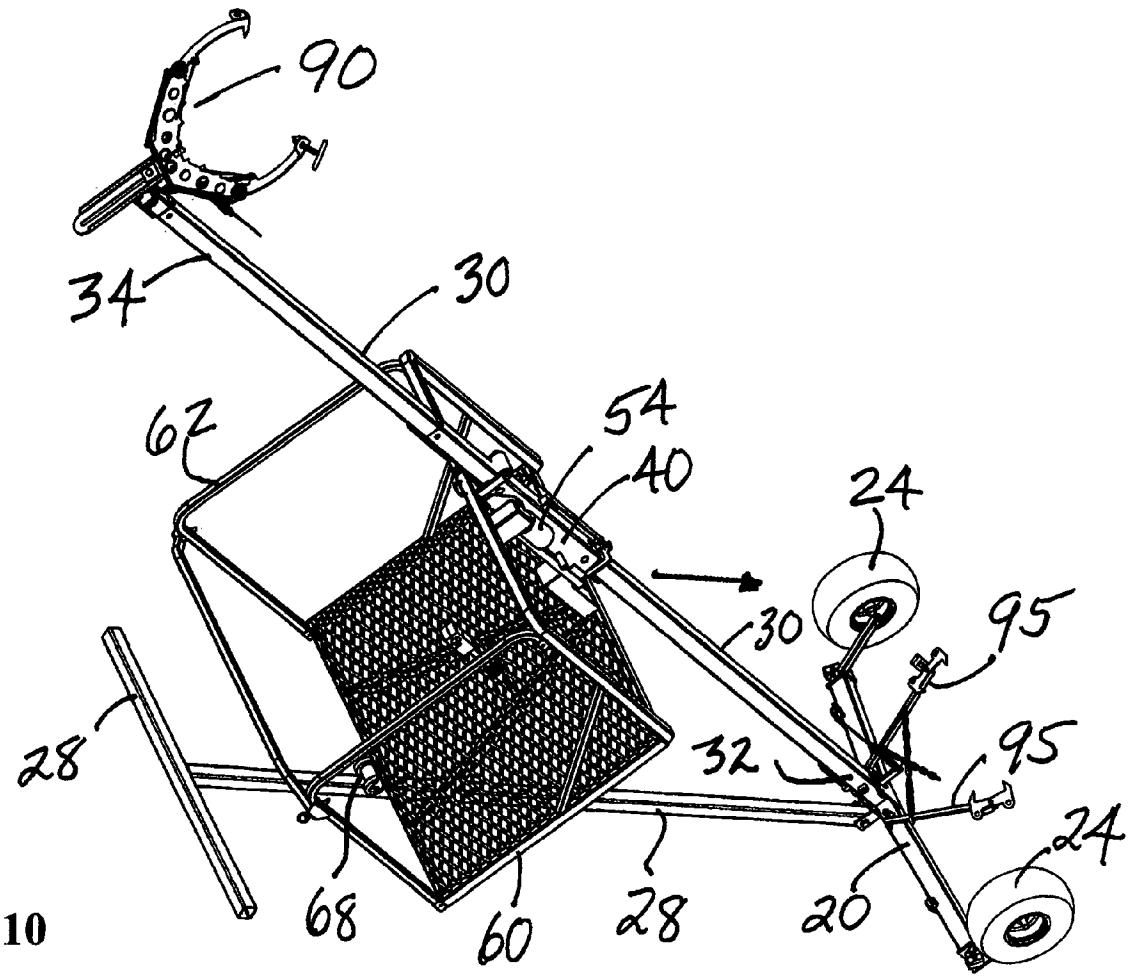
FIG. 10 is a perspective view of the first embodiment of the transportable, self-erecting, battery powered, vertical lift assembly of the present invention with the stabilizer frame section attached.

Referring now to FIGS. 9-14, a first embodiment of the transportable, self-erecting, battery powered, vertical lift assembly 10 is illustrated. The transportable lift assembly 10 includes a wheeled frame member 20, having at least two wheel members 24 secured to one end of the frame member 20, and a towing attachment mechanism 26 opposite the frame member 20. A detailed view of the towing attachment mechanism 26 is provided in FIG. 9*b*. The linear guide member 30 is pivotally secured at a first end 32 to the frame member 20 adjacent to the two wheel members 24 thereof. The first embodiment of the transportable lift assembly 10 is designed to be pulled with an ATV or similar small vehicle. In this embodiment, the linear guide member 30 also functions as a portion of the towing attachment mechanism 26, with a ball-accepting, towing attachment mechanism 26 removably secured to the second end 34 of the linear guide member 30. As illustrated in FIG. 10, the ball-accepting, towing attachment mechanism 26 is replaced by a first anchoring assembly 90 for securing the linear guide member 30 to a vertical support structure, such as a tree, as described below.

In order to secure the linear guide member 30 to a vertical support, such as a tree, and elevate the platform member 60, an additional stabilizing frame section 28 is secured to the frame member 20 adjacent the first end 32 of the linear guide member 30. The stabilizing frame section 28 can be transported withing the linear guide member 30 and removed for attachment to the frame member 20 prior to erecting the vertical lift assembly 10. The lifting portion 15, including the carriage member 50 and attached platform member 60, is positioned between the stabilizing frame section 28 and the linear guide member 30, as illustrated in FIG. 10. At this point, a first anchoring assembly 90 replaces the ball-accepting, towing attachment mechanism 26 at the second end 34 of the linear guide member 30. A roller member 68, attached to an edge of the platform member 60, engages the stabilizing frame section 28 for facile movement of the platform member 60 there along.

Figure 11:
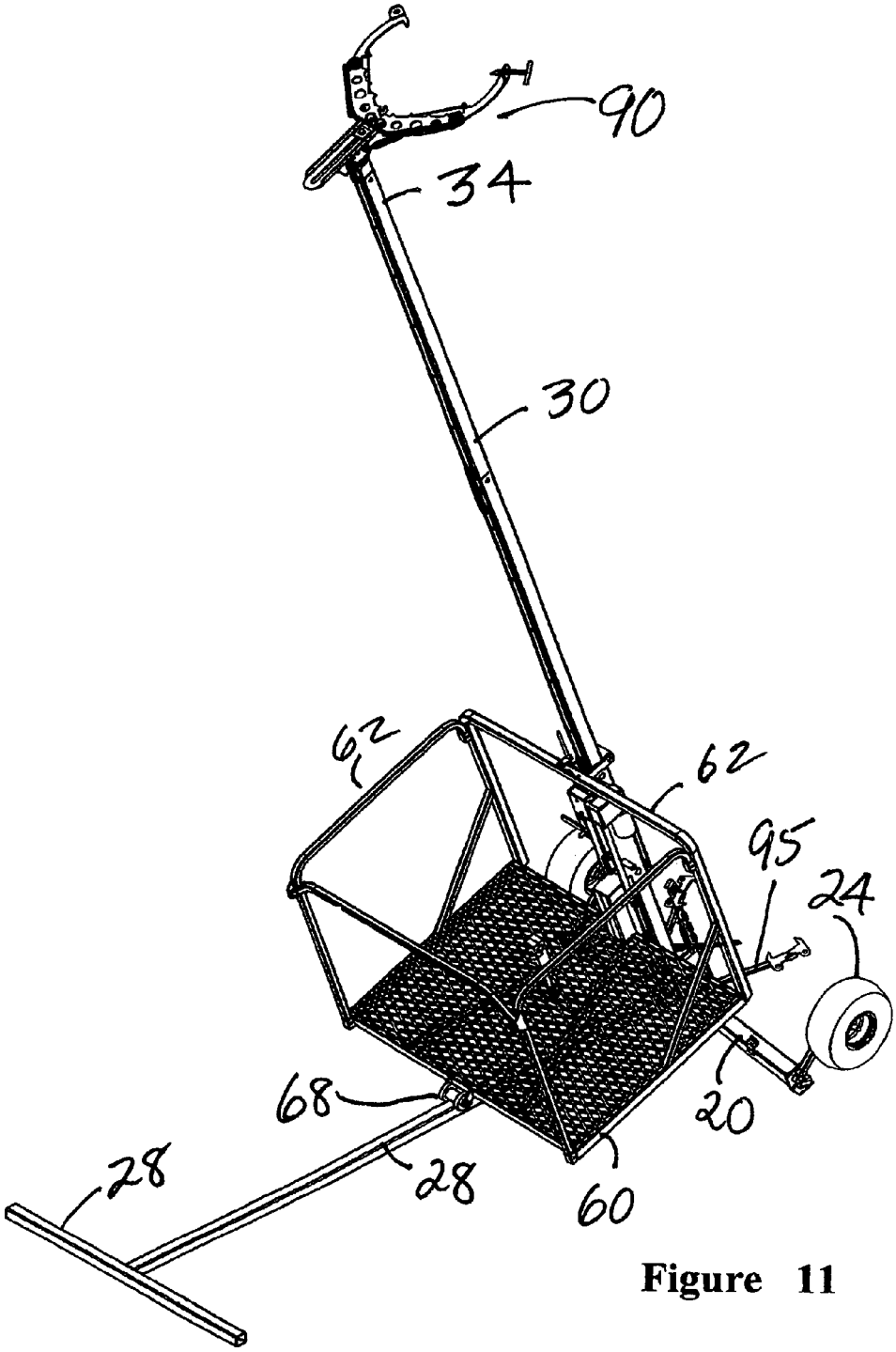
FIG. 11 is a perspective view of the partially erected first embodiment of the transportable, self-erecting, battery powered, vertical lift assembly of the present invention.
Figure 12:
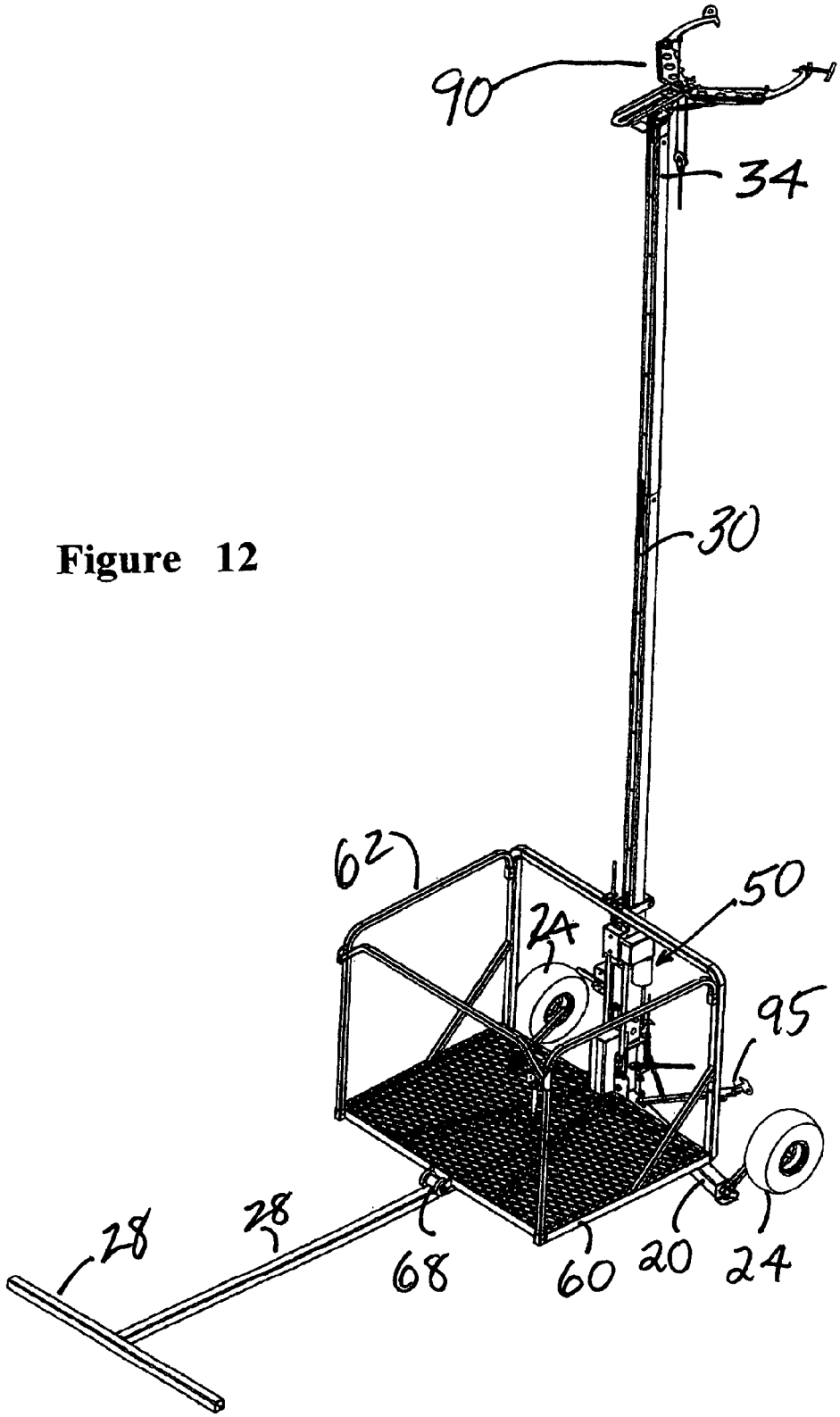
FIG. 12 is another perspective view of the fully erected first embodiment of the transportable, self-erecting, battery powered, vertical lift assembly of the present invention.

With the frame member 20 positioned adjacent the base of a tree, the carriage member 50 and attached platform member 60 are then moved toward the first end 32 of the linear guide member 30 by controlled rotation of the sprocket 58, engaged with the link chain member 40 on the linear guide member 30. This movement pivots and elevates the linear guide member 30 to essentially vertical, which then engages the essentially vertical support structure, the tree, by means of the attached first anchoring assembly 90. This elevating sequence is illustrated in FIGS. 10-12. A second anchoring assembly 95, secured to the frame member 20, provides additional attachment of the vertical lift assembly 10 to the vertical support structure, such as a tree. Preferably, safety cables (not shown) attached to the first end 32 and second end 34 of the linear guide member 30 encircle the vertical support structure (such as a tree) for additional safety. The anchoring assemblies 90, 95 and stabilizing frame section 28 provide a stable foundation for the linear guide member 30, the engaged carriage member 50 and the platform member 60 attached thereto.

Figure 13:
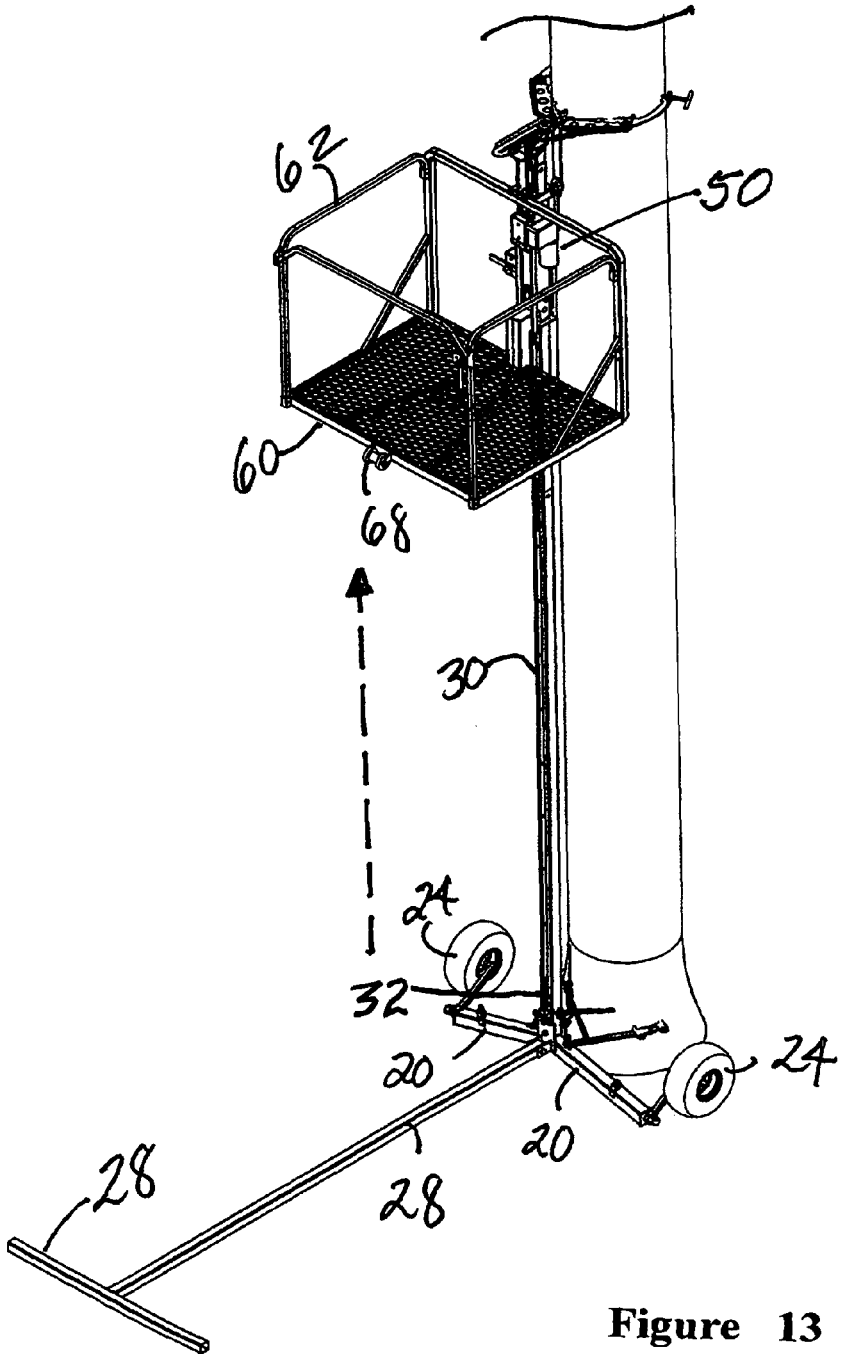
FIG. 13 is a perspective view of the fully erected first embodiment of the transportable, self-erecting, battery powered, vertical lift assembly of the present invention attached to a vertical support structure with the platform member in an elevated position.
Figure 14A:
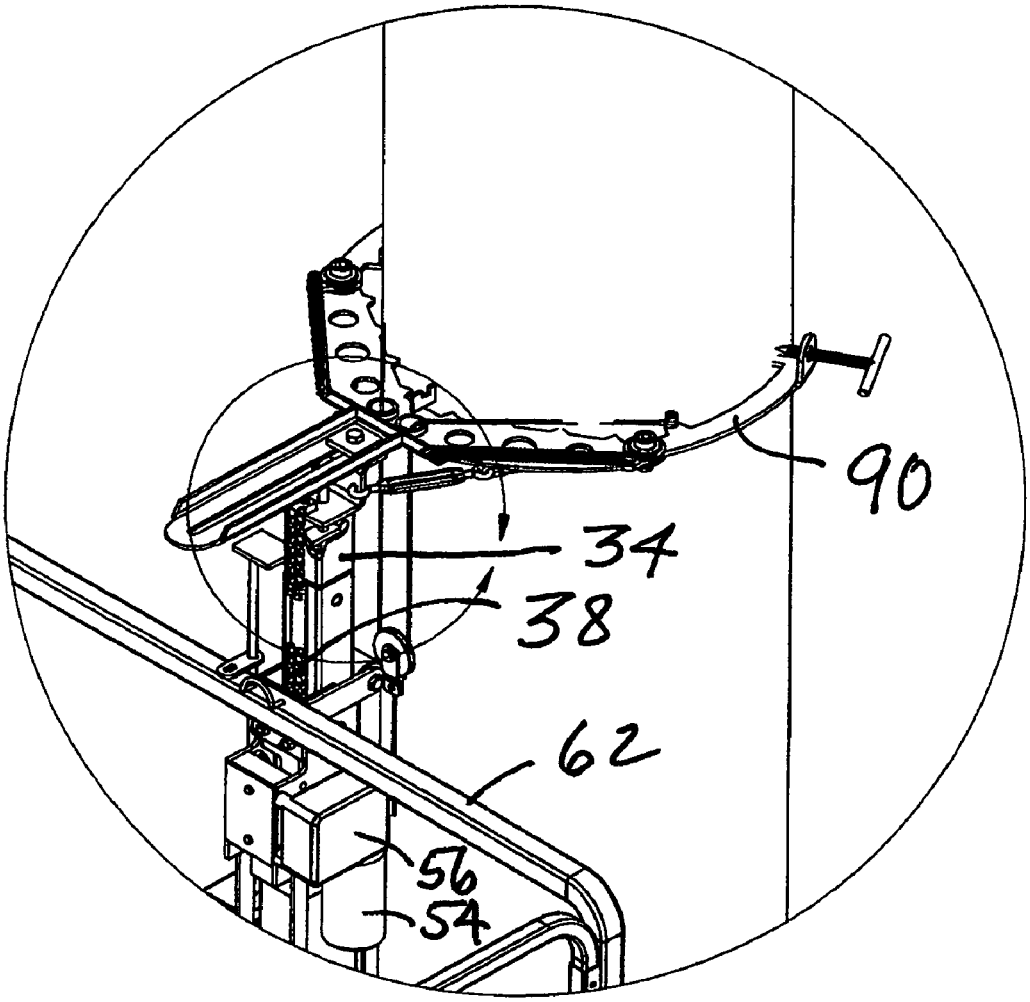
FIG. 14*a* is an enlarged view of the first anchoring assembly of the first embodiment of the transportable, self-erecting, battery powered, vertical lift assembly of the present invention.
Figure 14B:
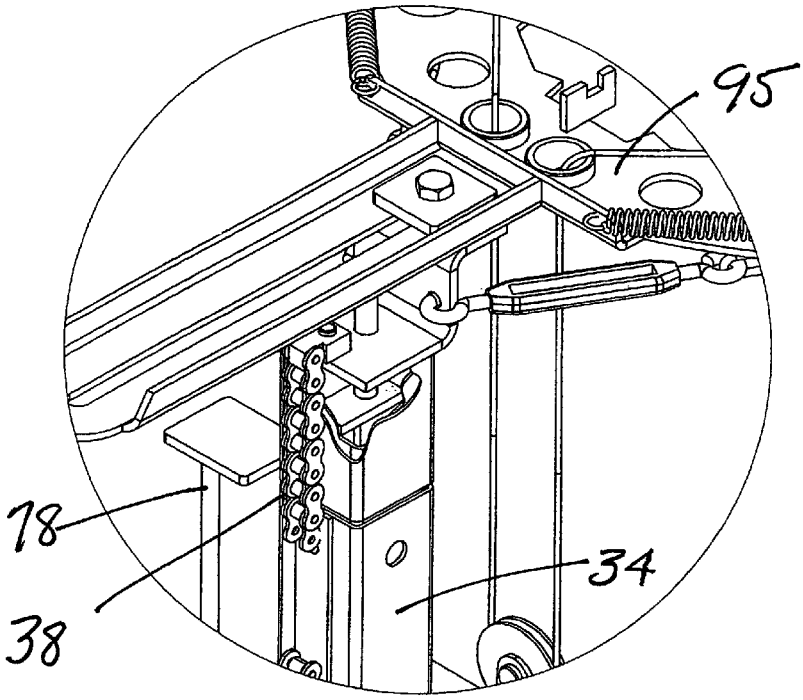
FIG. 14*b* is another enlarged view of the first anchoring assembly of the first embodiment of the transportable, self-erecting, battery powered, vertical lift assembly of the present invention.
Figures 15A, 15B:
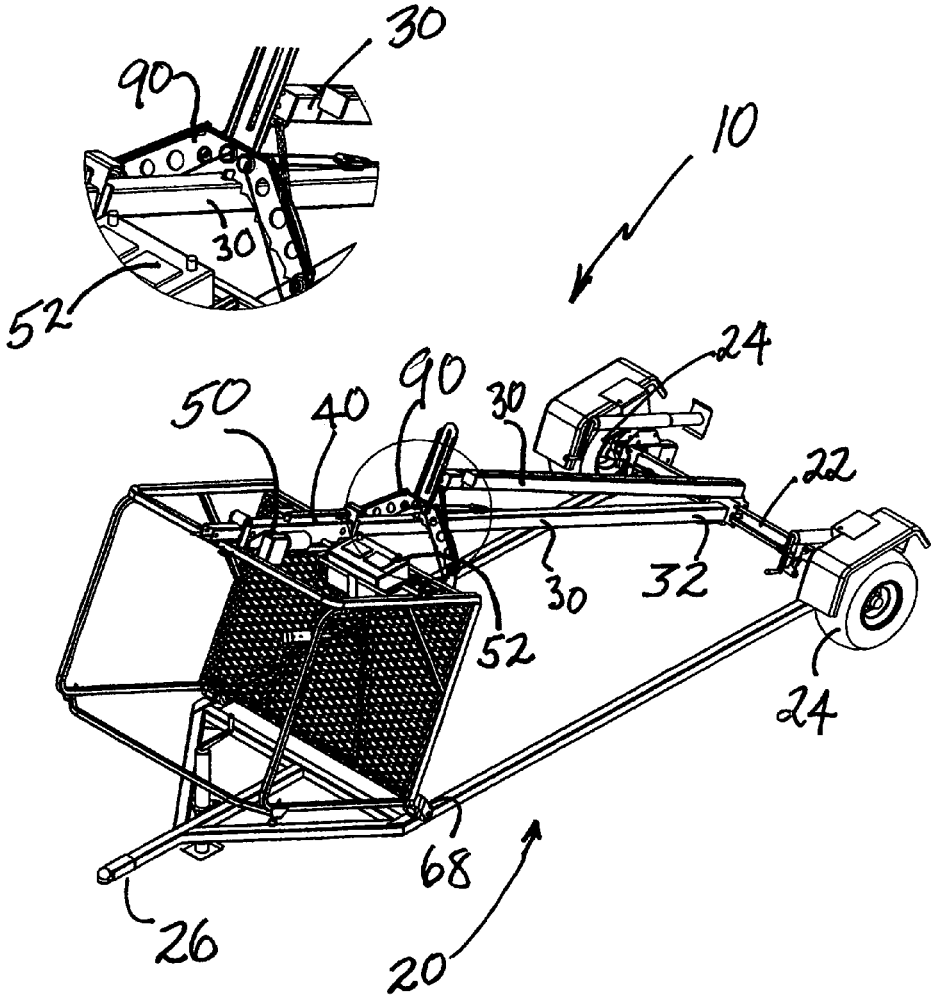
FIG. 15*a* is a perspective view of a second embodiment of the transportable, self-erecting, battery powered, vertical lift assembly of the present invention.
FIG. 15*b* is an enlarged view of the first anchoring assembly of the second embodiment of the transportable, self-erecting, battery powered, vertical lift assembly of the present invention.

The carriage member 50 and attached platform member 60 are, then moveable toward the second end 34 of the linear guide member 30 by controlled rotation of the sprocket 58, engaged with the link chain member 40 on the linear guide member 30, to elevate the carriage member 50 and attached platform member 60. The full elevation of the platform member 60 is illustrated in FIG. 13. Details of the construction of the first anchoring assembly 90 is provided in FIGS. 14*a* and 14*b*.

The safety brake assembly 80 is actuated to immobilize the carriage member 50 with respect to the linear guide member 30 upon relative movement between the carriage member 50 and the drive mechanism 40. The safety brake assembly 80 locks the carriage member 50 to the linear guide member 30 upon either mechanical or electrical failure of any component of the lift assembly 10. The safety brake assembly 80 in an unlocked condition is shown in FIG. 7 and in a locked condition in FIG. 8.

Figure 16:
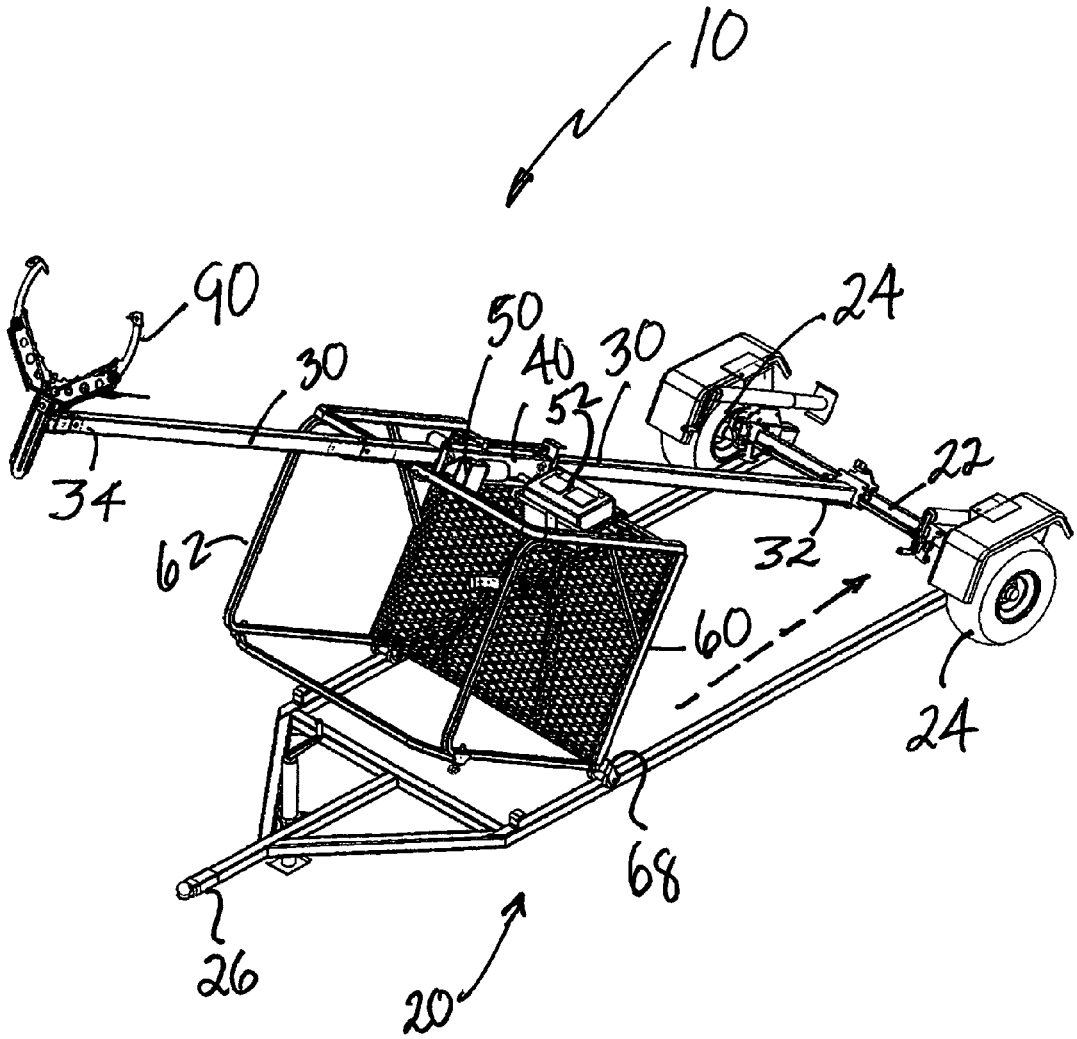
FIG. 16 is a perspective view of the second embodiment of the transportable, self-erecting, battery powered, vertical lift assembly of the present invention assembled for erecting.
Figure 17:
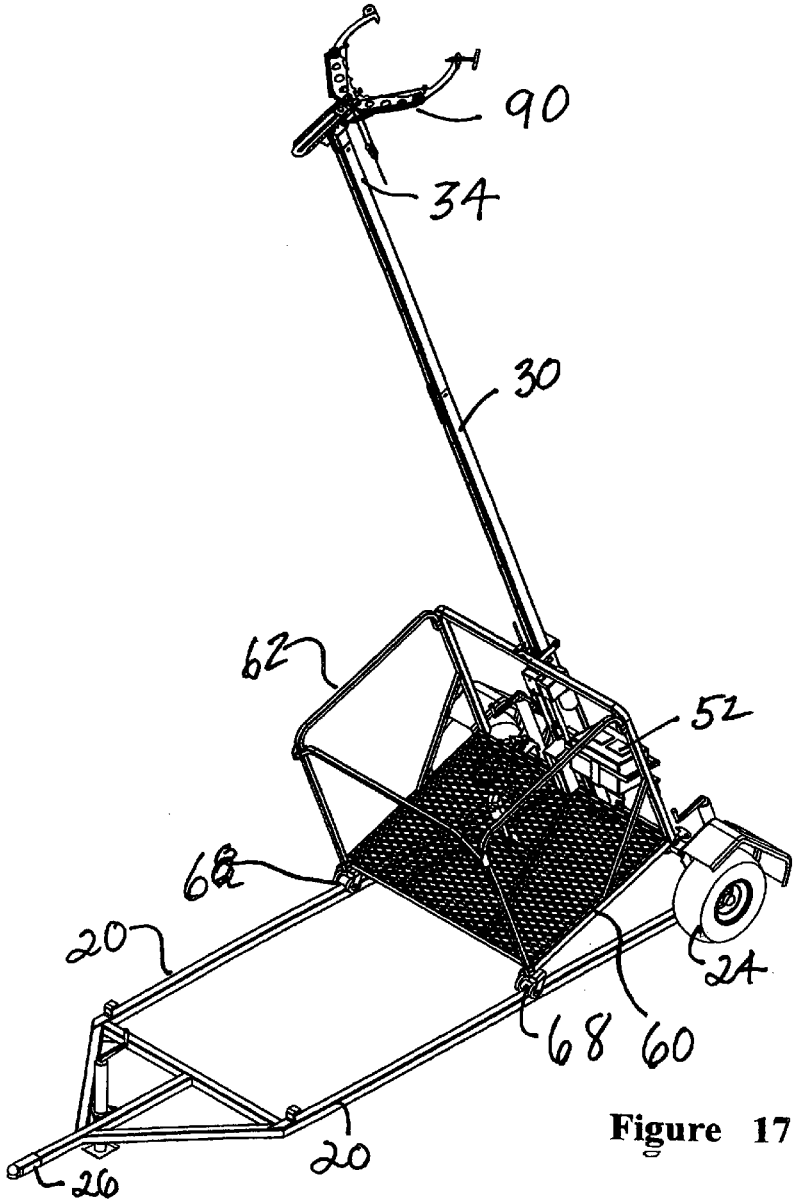
FIG. 17 is a perspective view of the partially erected, second embodiment of the transportable, self-erecting, battery powered, vertical lift assembly of the present invention.
Figure 18:
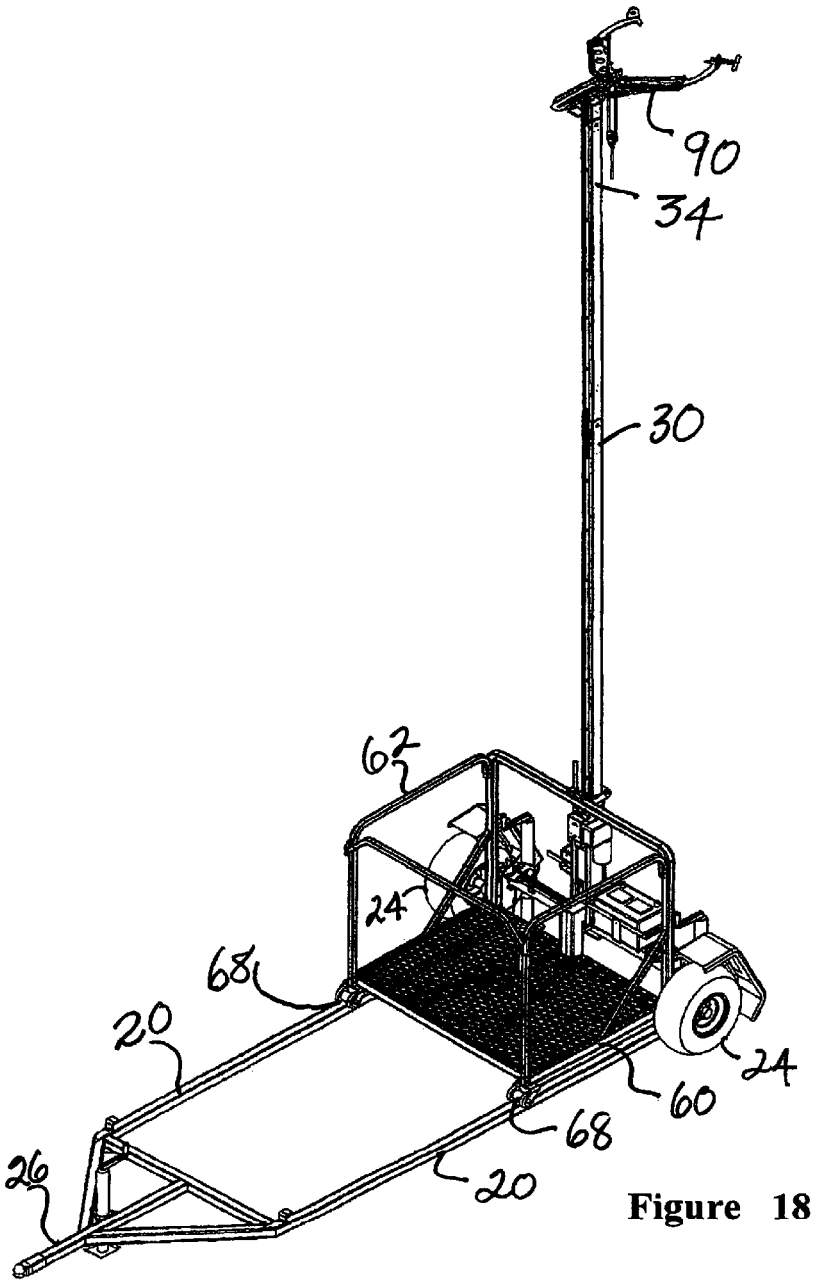
FIG. 18 is a perspective view of the fully erected, second embodiment of the transportable, self-erecting, battery powered, vertical lift assembly of the present invention.
Figure 19:
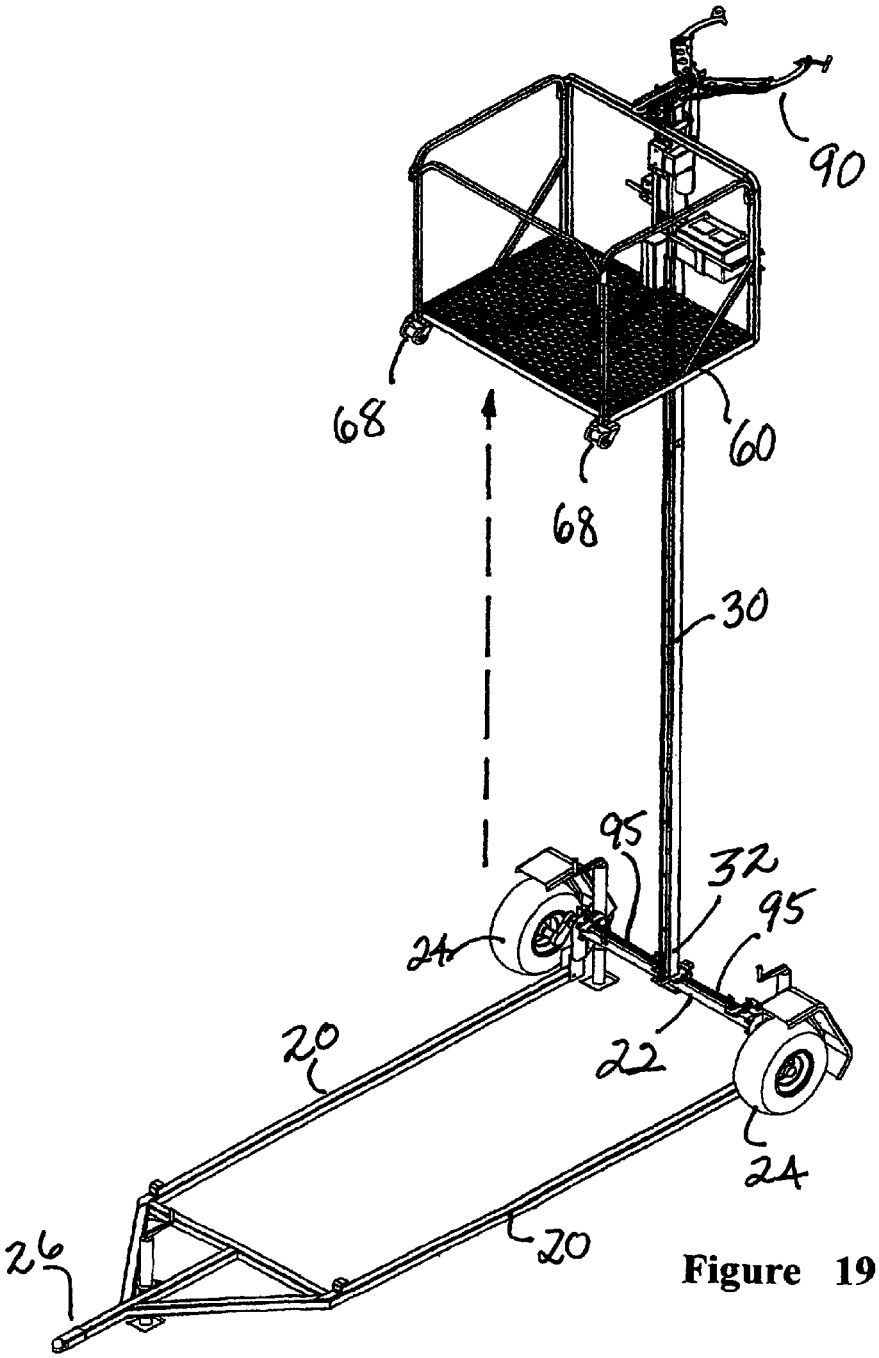
FIG. 19 is a perspective view of the fully erected, second embodiment of the transportable, self-erecting, battery powered, vertical lift assembly of the present invention with the platform member in an elevated position.

Referring now to FIGS. 15-19, a second embodiment of the transportable, self-erecting, battery powered, vertical lift assembly 10 is illustrated. The second embodiment is suitable for trailering over the highway. In the second embodiment, the wheeled frame member 20 is generally rectangular, with the pair of wheel members 24 mounted to an axle 22 secured to the frame member 20. The lifting portion 15, which includes the platform member 60 and attached carriage member 50, is positioned adjacent the second end 34 of the linear guide member 30 and between the frame member 20 and the linear guide member 30 for transport, as illustrated in FIG. 15*a*. The linear guide member 30 is provided in two sections that attach together for use, as shown in FIG. 16. The roller chain member 38 is attached to an exterior surface of the linear guide member 30 after the sections thereof are attached together. The first anchoring assembly 90 is secured to the second end 34 of the guide member 30, and the second anchoring assembly 95 is secured to the frame member 20 adjacent the pivotal attachment of the first end 32 of the linear guide member 30. Again, the transportable lift assembly 10 is placed against the base of a tree, with the linear guide member 30 having the first anchoring assembly 90 affixed at the second end 34 thereof. The second anchoring assembly 95 is secured to the frame member 20 adjacent the wheel members 24 for anchoring the frame member 20 to the vertical support structure, such as a tree. The elevation of the linear guide member 30, attachment to the tree, and movement of the platform member 60 and attached carriage member 40 occurs as described above, for the first embodiment. The sequence is illustrated in FIGS. 16-19. The power source, in the form of a battery member 52, is mounted on the platform member 60, adjacent the drive mechanism 50. The battery member 52 is not shown in FIGS. 1-14 for purposes of clarity. In this embodiment, the platform member 60 contains a pair of roller members 68 that engage the frame member 20 during elevation or lowering of the linear guide member 30.

Referring now to FIGS. 20-25, a third embodiment of the transportable, self-erecting, battery powered, vertical lift assembly 10 is illustrated. The third embodiment also is suitable for trailering over the highway. In the third embodiment, the wheeled frame member 20 is generally rectangular with a pair of linear guide members 30 extending vertically upward there from in spaced-apart relationship. Each linear guide member 30 includes a roller chain member 38, secured to an exterior surface thereof and extending the full length of the guide member 30. A separate carriage member 40 is moveably attached to each linear guide member 30, with a gear unit 56 operatively connected to a sprocket member 58, which engages the roller chain member 38 of each linear guide member 30. Each carriage member 40 is attached to a single platform member 60 positioned between the two linear guide members 30.

Figure 23:
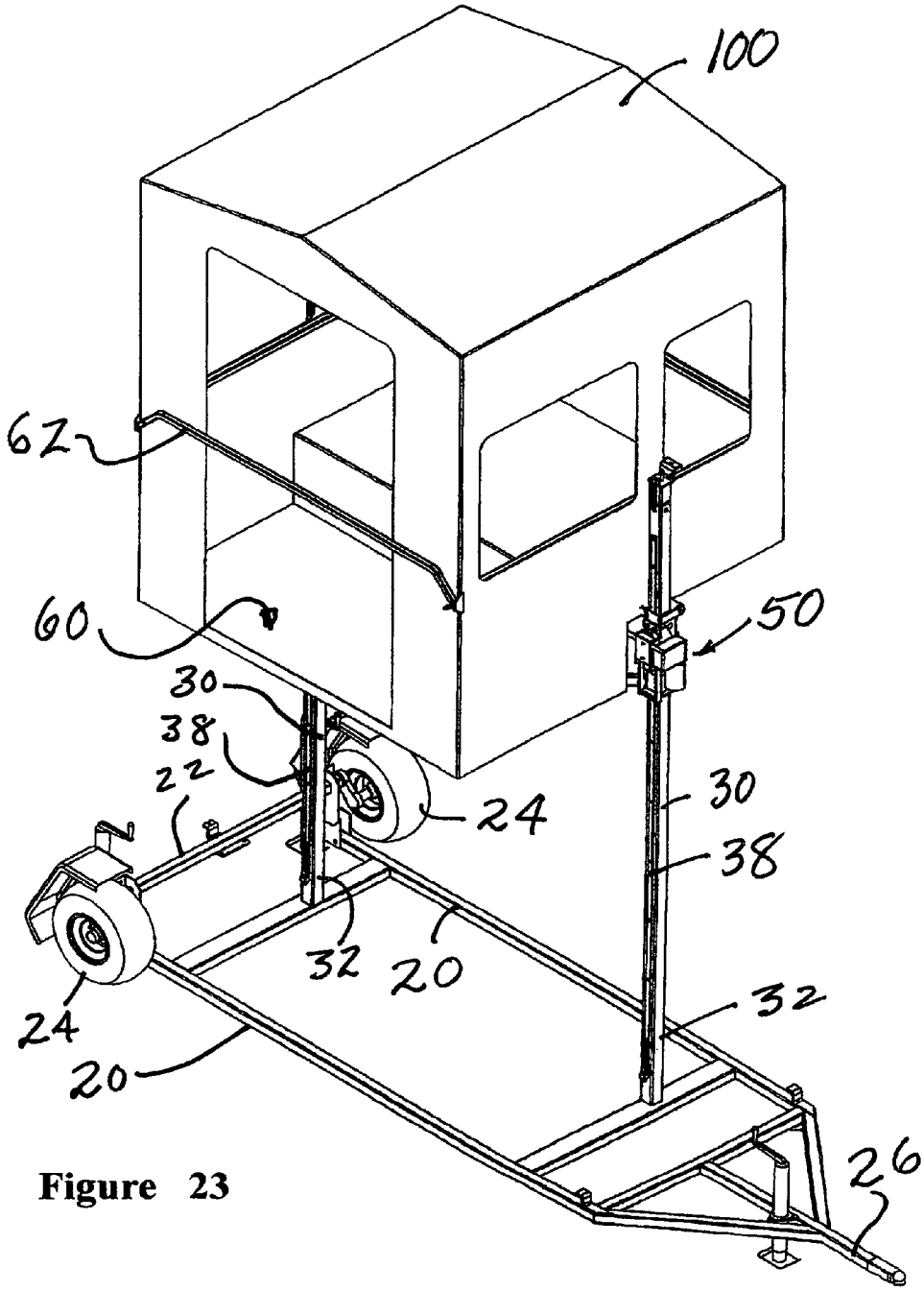
FIG. 23 is a perspective view of a third embodiment of the transportable, self-erecting, battery powered, vertical lift assembly of the present invention with the platform member in an elevated position.
Figure 24:
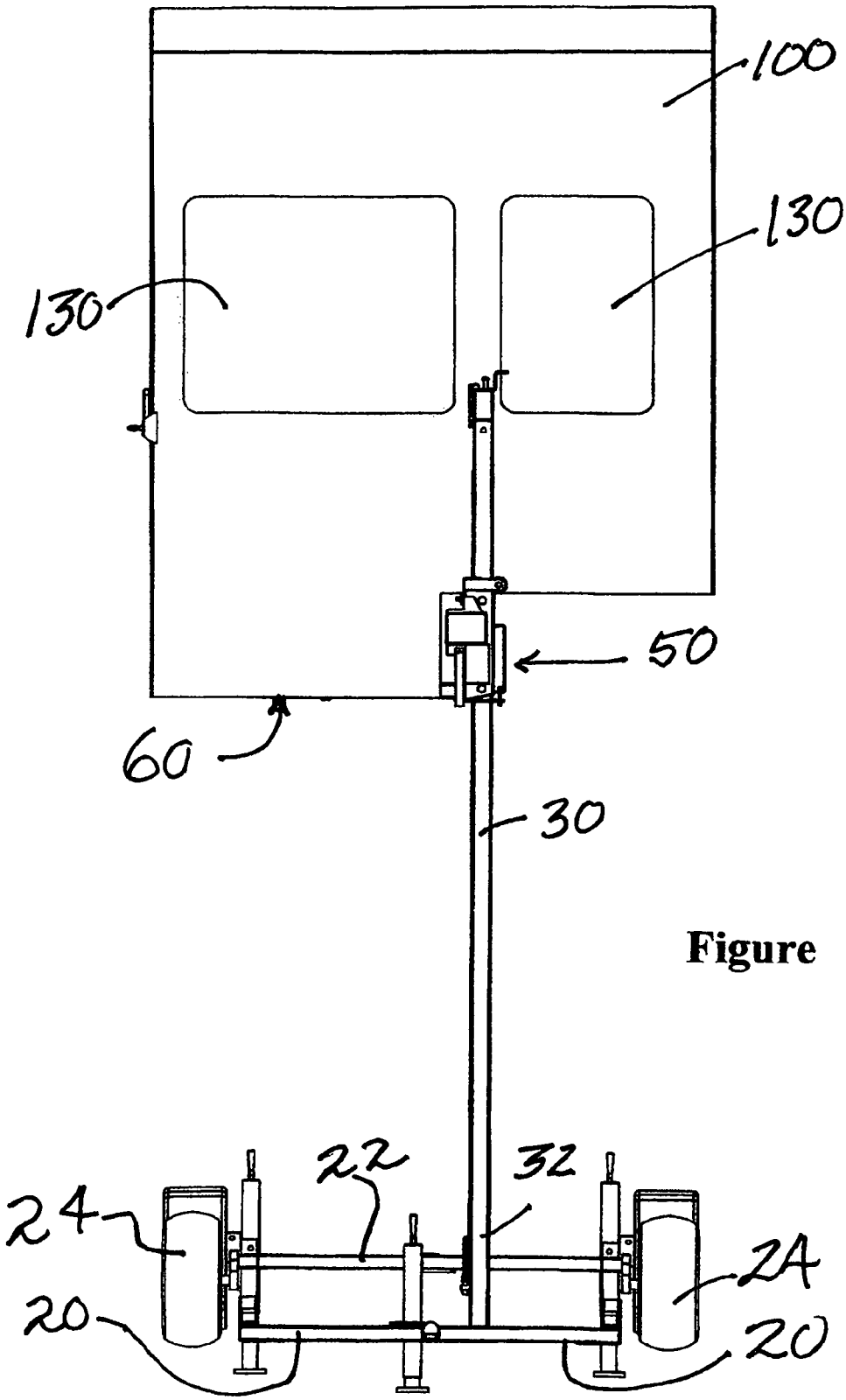
FIG. 24 is a perspective, front view of a third embodiment of the transportable, self-erecting, battery powered, vertical lift assembly of the present invention with the platform member in an elevated position.
Figure 25:
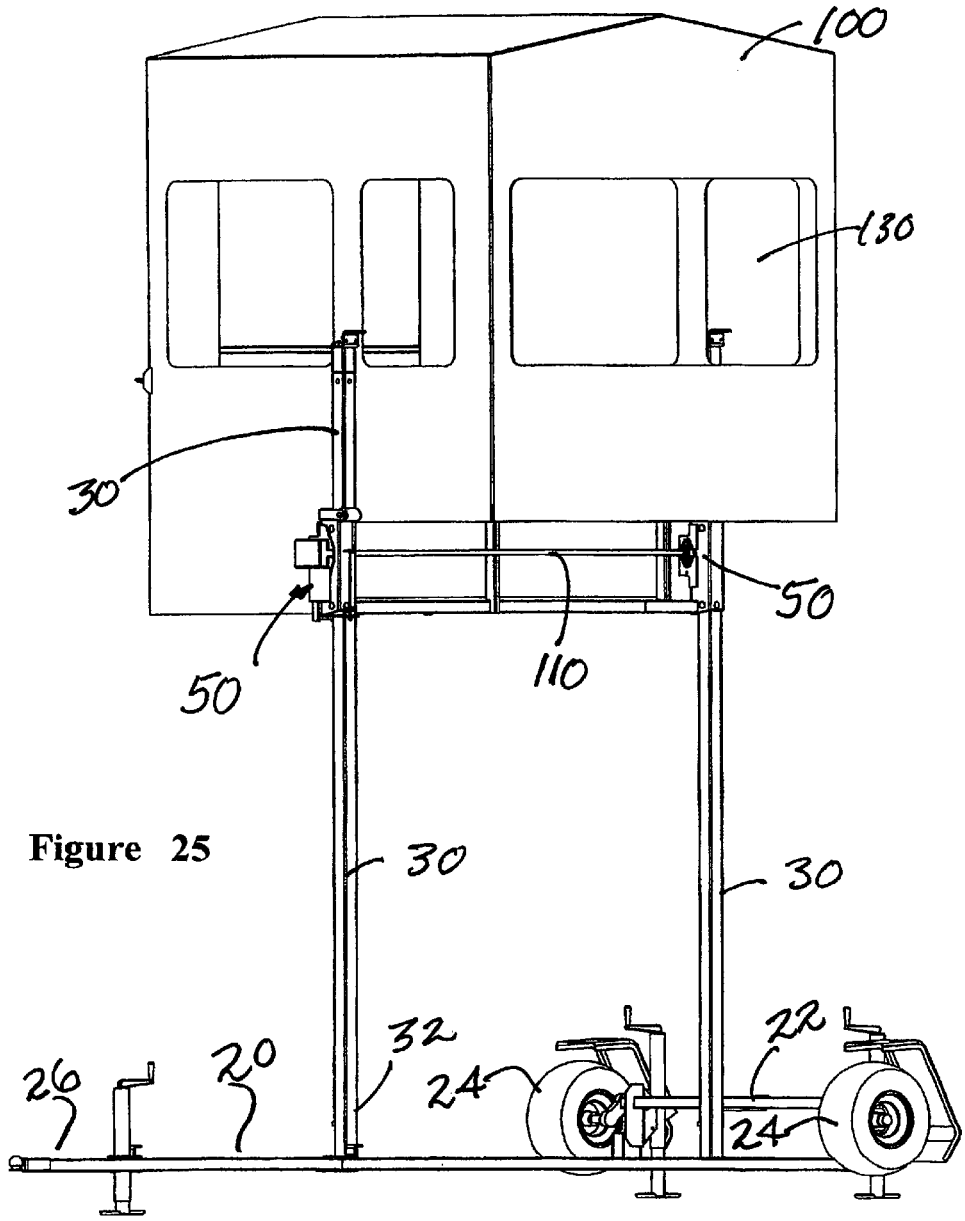
FIG. 25 is a perspective view of a third embodiment of the transportable, self-erecting, battery powered, vertical lift assembly of the present invention with the platform member in an elevated position.

In this embodiment, the platform member 60 includes a covered shelter 100 extending upwardly from the platform member 60, as illustrated in FIGS. 20-25. A single battery powered DC motor 54 operates the gear unit 56 of each carriage member 40, with a power shaft member 110 connecting the two gear units 56, enabling the tandem carriage members 50 to function in unison. The power shaft member 110 is best seen in FIG. 25. The power source, a battery member 52, is mounted to the platform member 60. Each carriage member 50 is equipped with a safety brake assembly 80 to immobilize the carriage member 40 with respect to the linear guide member 30 upon relative movement between the carriage member 40 and the drive mechanism 50, as described above for the first and second embodiments of the vertical lift assembly 10. Preferably, the storage battery member 52 is positioned within the covered shelter 100. The covered shelter 100 includes an access opening 120 with a safety railing 64 and several viewing windows 130.

Figure 20:
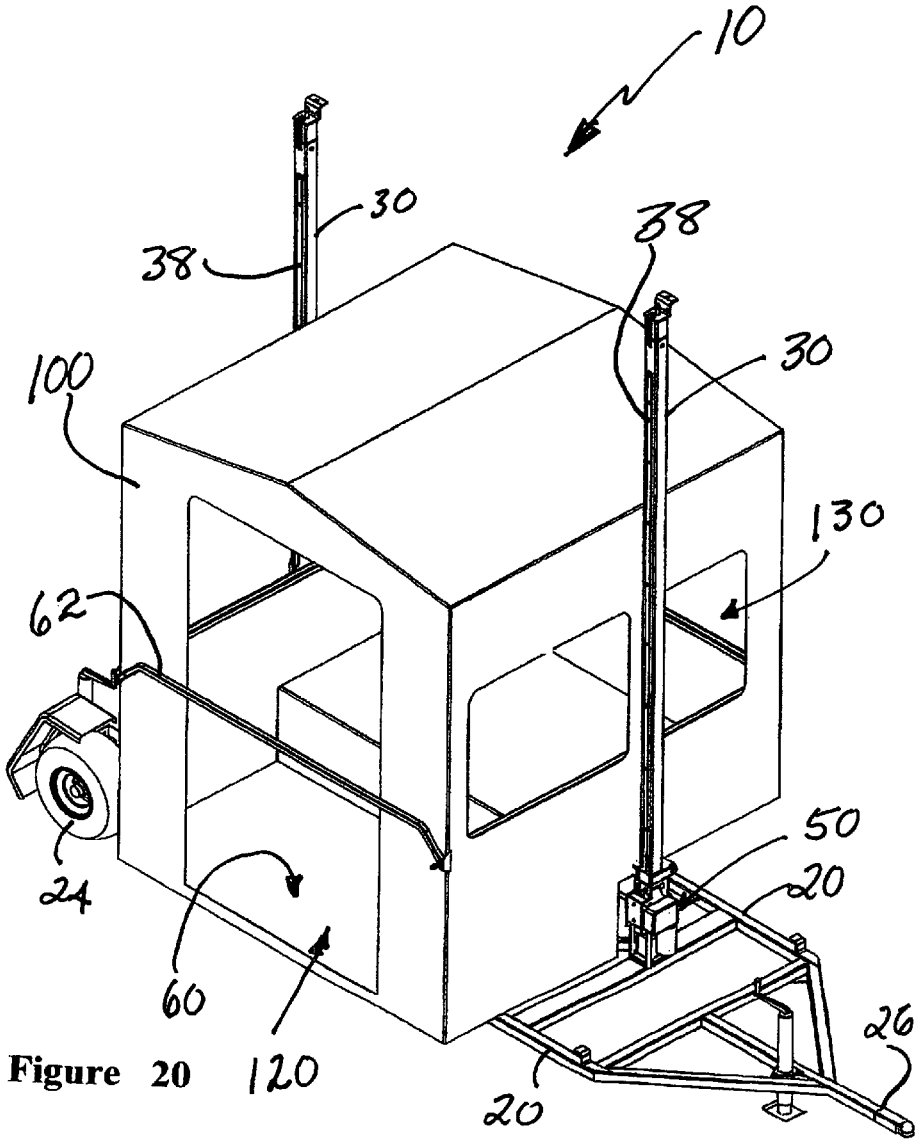
FIG. 20 is a perspective view of a third embodiment of the transportable, self-erecting, battery powered, vertical lift assembly of the present invention.
Figure 21:
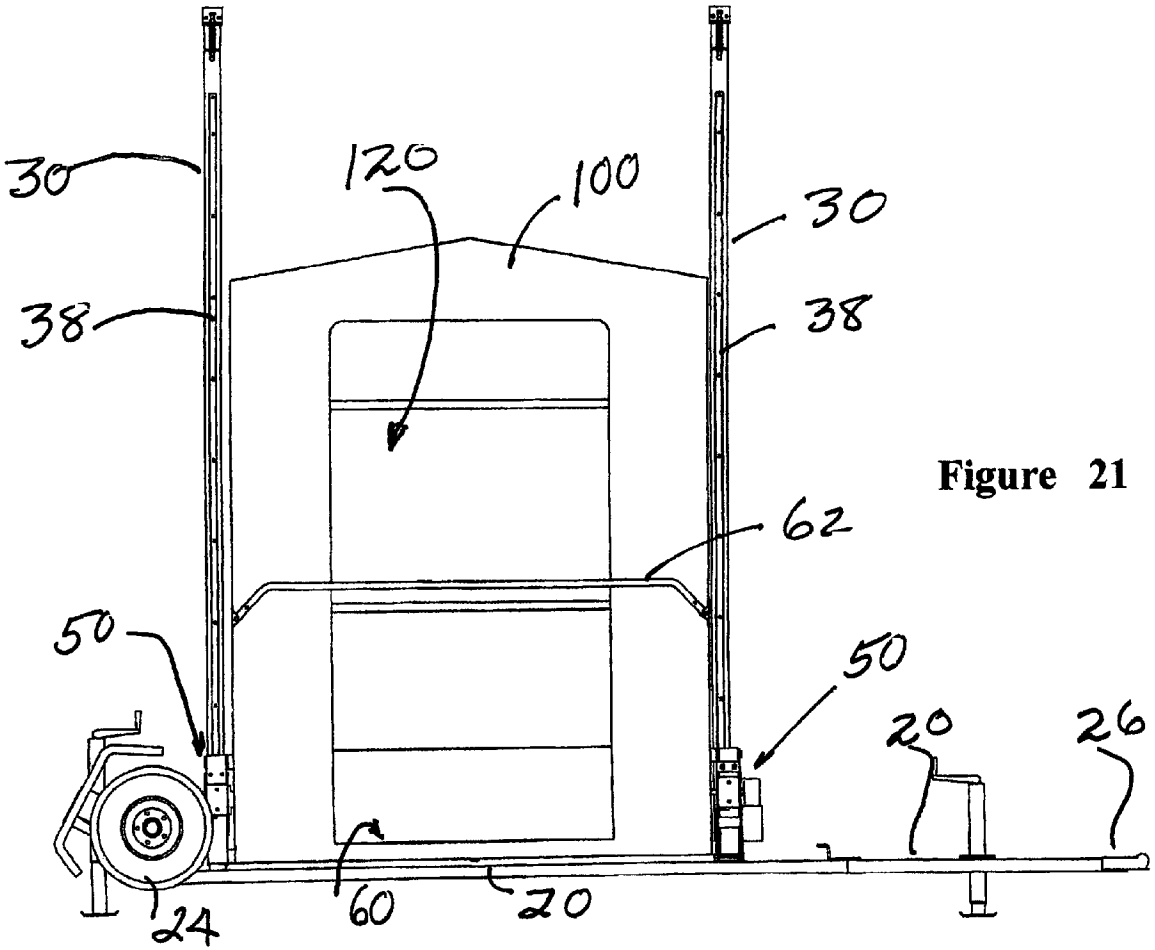
FIG. 21 is a perspective, side view of a third embodiment of the transportable, self-erecting, battery powered, vertical lift assembly of the present invention.
Figure 22:
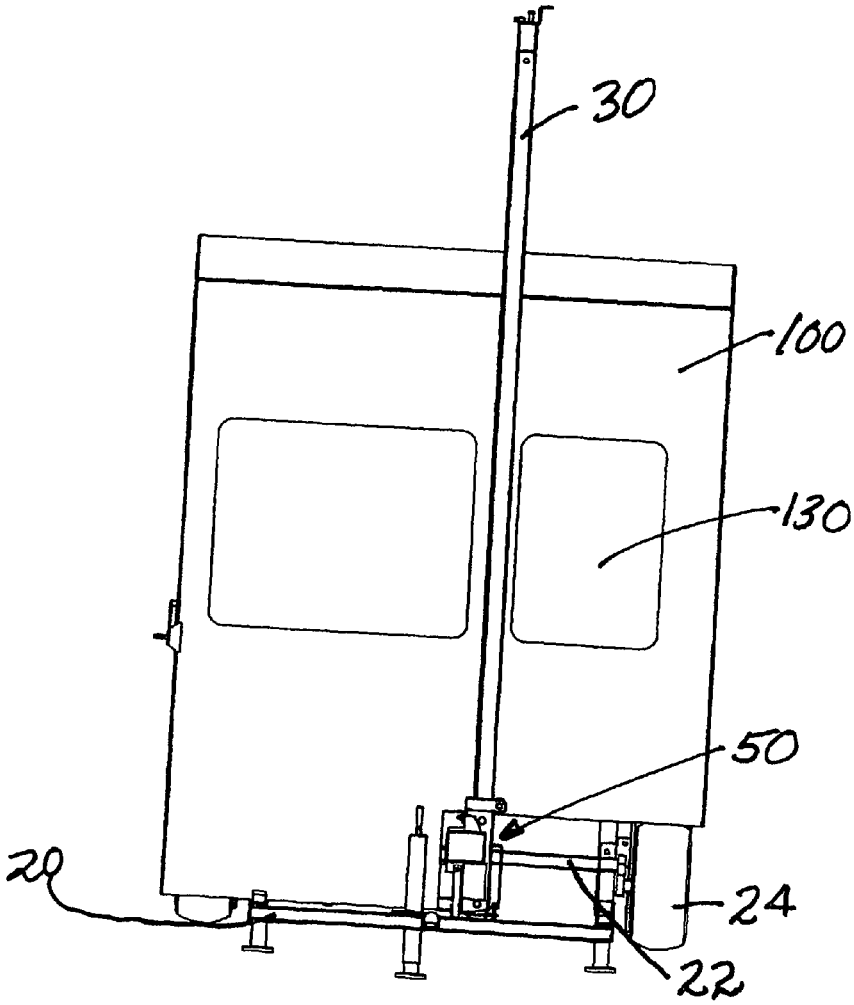
FIG. 22 is a perspective, front view of a third embodiment of the transportable, self-erecting, battery powered, vertical lift assembly of the present invention.

The third embodiment of the lift assembly 10, with the platform member 60 and attached shelter member 100 in the lowest position, is illustrated in FIGS. 20-22. Actuating the drive mechanism 50 causes each carriage member 40 to ascend the attached linear guide member 30 in unison, thereby raising the platform member 60 and covered shelter 100 to an elevated location. The third embodiment of the lift assembly 10 in an elevated position is illustrated in FIGS. 23-25. The height of the linear guide members 30 is selected so that the lift assembly 10 of the third embodiment can be trailered under all standard height highway overpasses.

While the invention has been particularly shown and described with reference to preferred embodiments thereof, it will be understood by those skilled in the art that various changes in form and details may be made therein without departing from the spirit and scope of the invention.

We claim:

1. A transportable, self-erecting, battery powered, vertical lift assembly adapted for raising and lowering a load vertically, the transportable, self-erecting, battery powered, vertical lift assembly comprising:

a wheeled frame member having at least two wheel members secured to the frame member and a towing attachment mechanism secured to the frame member opposite the wheel members;

a linear guide member of selected length pivotally secured at a first end to the frame member adjacent the at least two wheel members thereof, the linear guide member adapted for securing to a substantially vertical structure;

a roller chain member secured to an exterior surface of the linear guide member and extending essentially the selected length of the linear guide member;

a carriage member movably attached to the linear guide member;

a platform member, which supports a load, rigidly attached to the carriage member;

the carriage member and attached platform member movable along the linear guide member by a drive mechanism supporting the carriage member;

the drive mechanism comprising a battery member powering a DC motor member driving a gear unit operatively connected to a sprocket member, which engages the roller chain member on the linear guide member, the supported carriage member and attached platform member moved by controlled rotation of the sprocket member engaged with the roller chain member on the linear guide member;

a control switch member selectively controlling operation of the DC motor member; and a safety brake assembly actuated to immobilize the carriage member with respect to the linear guide member upon relative movement between the carriage member and the drive mechanism;

whereby the carriage member and attached platform member move along the linear guide member in one direction, by controlled rotation of the sprocket engaged with the roller chain member on the linear guide member, to pivot and elevate the guide member, which is adapted to engage an essentially vertical support structure;

the carriage member and attached platform member then moves along the linear guide member in an opposite direction, by controlled rotation of the sprocket engaged with the roller chain member on the linear guide member, to vertically elevate the carriage member and attached platform member.

2. The transportable, self-erecting, battery powered, vertical lift assembly adapted for raising and lowering a load vertically of claim 1, wherein the linear guide member is hollow and rectangular in cross section, and the carriage member essentially encircles the linear guide member and roller chain member attached thereto.

3. The transportable, self-erecting, battery powered, vertical lift assembly adapted for raising and lowering a load vertically of claim 1, wherein the platform member includes an expanded metal mesh support surface and further includes a safety railing surrounding at least a portion of the platform member and a vertical locking peg extending upwardly from the platform member.

4. The transportable, self-erecting, battery powered, vertical lift assembly adapted for raising and lowering a load vertically of claim 1, wherein the safety brake assembly includes a biased brake clamp member encircling the linear guide member and pivotally contacting the carriage member, the brake clamp member biased in an unlocked state with the drive mechanism supporting the carriage member and actuated to a locked state upon relative movement between the carriage member and the drive mechanism, thereby locking the carriage member and attached platform member to the linear guide member.

5. The transportable, self-erecting, battery powered, vertical lift assembly adapted for raising and lowering a load vertically of claim 1, wherein the control switch member includes a handle portion that actuates the DC motor member to raise the carriage member and attached platform member upon raising the handle portion and actuates the DC motor member to lower the carriage member and attached platform member upon lowering the handle portion.

6. The transportable, self-erecting, battery powered, vertical lift assembly adapted for raising and lowering a load vertically of claim 1, further including a first anchoring assembly attached to a second end of the linear guide member and a second anchoring assembly attached adjacent the first end of the linear guide assembly, the first and second anchoring assemblies adapted for securing the linear guide member to a substantially vertical structure.

7. The transportable, self-erecting, battery powered, vertical lift assembly adapted for raising and lowering a load vertically of claim 1, further including a stabilizer frame section attachable to the frame member for stabilizing the vertical lift assembly in an upright orientation.

8. The transportable, self-erecting, battery powered, vertical lift assembly adapted for raising and lowering a load vertically of claim 1, further including at least one roller member fastened to the platform member for facile movement of the platform member along the frame member.

9. The transportable, self-erecting, battery powered, vertical lift assembly adapted for raising and lowering a load vertically of claim 1, wherein the frame member is T-shaped with an arm section having a wheel member at each end thereof and a leg section extending from a midpoint thereof with the towing attachment mechanism at an end of the leg section opposite the arm section.

10. The transportable, self-erecting, battery powered, vertical lift assembly adapted for raising and lowering a load vertically of claim 1, wherein the frame member is rectangular with a wheel member at adjacent corners of one end thereof, and the towing attachment mechanism secured to the frame member opposite the wheel members.

11. A transportable, self-erecting, battery powered, vertical lift assembly adapted for raising and lowering a load vertically, the transportable, self-erecting, battery powered, vertical lift assembly comprising:

a wheeled frame member having at least two wheel members secured to the frame member and a towing attachment mechanism secured to the frame member opposite the wheel members;

a hollow linear guide member of selected length with a rectangular cross section, the linear guide member pivotally secured at a first end to the frame member adjacent the at least two wheel members thereof, the linear guide member adapted for securing to a substantially vertical structure;

a roller chain member secured to an exterior surface of the linear guide member and extending essentially the selected length of the linear guide member;

a carriage member movably attached to the linear guide member, the carriage member essentially encircing the linear guide member and roller chain member attached thereto;

a platform member, which supports a load, rigidly attached to the carriage member;

the carriage member and attached platform member movable along the linear guide member by a drive mechanism supporting the carriage member;

the drive mechanism comprising a battery member powering a DC motor member driving a gear unit operatively connected to a sprocket member, which engages the roller chain member on the linear guide member, the supported carriage member and attached platform member moved by controlled rotation of the sprocket member engaged with the roller chain member on the linear guide member;

a control switch member selectively controlling operation of the DC motor member; and a safety brake assembly actuated to immobilize the carriage member with respect to the linear guide member upon relative movement between the carriage member and the drive mechanism, the safety brake assembly including a biased brake clamp member encircling the linear guide member and pivotally contacting the carriage member, the brake clamp member biased in an unlocked state with the drive mechanism supporting the carriage member and actuated to a locked state upon relative movement between the carriage member and the drive mechanism, thereby locking the carriage member and attached platform member to the linear guide member;

whereby the carriage member and attached platform member move along the linear guide member in one direction, by controlled rotation of the sprocket engaged with the roller chain member on the linear guide member, to pivot and elevate the guide member, which is adapted to engage an essentially vertical support structure;

the carriage member and attached platform member then moves along the linear guide member in an opposite direction, by controlled rotation of the sprocket engaged with the roller chain member on the linear guide member, to vertically elevate the carriage member and attached platform member.

12. The transportable, self-erecting, battery powered, vertical lift assembly adapted for raising and lowering a load vertically of claim 11, wherein the platform member includes an expanded metal mesh support surface and further includes a safety railing surrounding at least a portion of the platform member and a vertical locking peg extending upwardly from the platform member.

13. The transportable, self-erecting, battery powered, vertical lift assembly adapted for raising and lowering a load vertically of claim 11, wherein the control member includes a handle portion that actuates the DC motor member to raise the carriage member and attached platform member upon raising the handle portion and actuates the DC, motor member to lower the carriage member and attached platform member upon lowering the handle portion.

14. The transportable, self-erecting, battery powered, vertical lift assembly adapted for raising and lowering a load vertically of claim 11, further including a first anchoring assembly attached to a second end of the linear guide member and a second anchoring assembly attached adjacent the first end of the linear guide assembly, the first and second anchoring assemblies adapted for securing the linear guide member to a substantially vertical structure.

15. The transportable, self-erecting, battery powered, vertical lift assembly, adapted for raising and lowering a load vertically of claim 11, further including a stabilizer frame section attachable to the frame member for stabilizing the vertical lift assembly in an upright orientation.

16. The transportable, self-erecting, battery powered, vertical lift assembly adapted for raising and lowering a load vertically of claim 11, further including at least one roller member fastened to the platform member for facile movement of the platform member along the frame member.

17. The transportable, self-erecting, battery powered, vertical lift assembly adapted for raising and lowering a load vertically of claim 11, wherein the frame member is T-shaped with an arm section having a wheel member at each end thereof and a leg section extending from a midpoint thereof with the towing attachment mechanism at an end of the leg section opposite the arm section.

18. The transportable, self-erecting, battery powered, vertical lift assembly adapted for raising and lowering a load vertically of claim 11, wherein the frame member is rectangular with a wheel member at adjacent corners of one end thereof, and the towing attachment mechanism secured to the frame member opposite the wheel members.

* * * * *